US009243469B2

(12) United States Patent
Guo et al.

(10) Patent No.: US 9,243,469 B2
(45) **Date of Patent: *Jan. 26, 2016**

(54) BLOWOUT PREVENTER AND RAMS

(71) Applicant: Stream-Flo Industries Ltd., Edmonton (CA)

(72) Inventors: Tianle Guo, Edmonton (CA); Tony M. Lam, Edmonton (CA); Keith David Farquharson, Edmonton (CA)

(73) Assignee: Stream-Flo Industries Ltd., Edmonton (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/310,852

(22) Filed: Jun. 20, 2014

(65) Prior Publication Data

US 2014/0299797 A1 Oct. 9, 2014

Related U.S. Application Data

(63) Continuation of application No. 13/472,997, filed on May 16, 2012, now Pat. No. 8,783,643, which is a continuation-in-part of application No. 12/967,421, filed on Dec. 14, 2010, now Pat. No. 8,807,516.

(60) Provisional application No. 61/286,508, filed on Dec. 15, 2009.

(51) Int. Cl.
*E21B 33/06* (2006.01)
*E21B 33/00* (2006.01)

(52) U.S. Cl.
CPC ..... *E21B 33/062* (2013.01); *E21B 2033/005* (2013.01)

(58) Field of Classification Search
CPC ..... E21B 33/062; E21B 2033/005
USPC ..... 251/1.1, 1.3; 277/494, 496–498, 458; 166/85.4, 364
See application file for complete search history.

(56) References Cited

U.S. PATENT DOCUMENTS

| | | | |
|---|---|---|---|
| 1,767,164 | A | 6/1930 | Ahern et al. |
| 1,886,340 | A | 11/1932 | King |
| 2,194,259 | A | 3/1940 | Allen |
| 2,639,198 | A | 5/1953 | Kirkham |
| 2,746,710 | A | 5/1956 | Jones |
| 3,720,140 | A | 3/1973 | Lee |
| 3,762,729 | A | 10/1973 | Hopp |

(Continued)

FOREIGN PATENT DOCUMENTS

| | | |
|---|---|---|
| CA | 2260655 | 8/2000 |

*Primary Examiner* — John K Fristoe, Jr.
*Assistant Examiner* — Reinaldo Sanchez-Medina
(74) *Attorney, Agent, or Firm* — Lathrop & Gage LLP

(57) ABSTRACT

A ram type blowout preventer having a seal on each ram, extending across the front face, rearwardly and then over the top portion or the bottom portion of the ram. Each ram forms a leading edge portion above or below the front face seal, so as opposing rams move into the extended sealing position, the leading edge portions of the rams press against each other, imparting a generally vertical movement to bring the seals on the front faces into sealing engagement with each other and to energize the seals extending over the top or bottom portions against the ram bores. The front face of each ram may include a portion which is inclined toward the central bore. Rope packing seals may be provided on the rams having a vertical offset at the front faces of the rams such that rope packing seals on opposing front faces seal against each other.

40 Claims, 19 Drawing Sheets

(56) References Cited

U.S. PATENT DOCUMENTS

| | | | | |
|---|---|---|---|---|
| 4,428,592 | A | 1/1984 | Shaffer | |
| 4,508,312 | A | 4/1985 | Taylor et al. | |
| 4,518,144 | A | 5/1985 | Vivic et al. | |
| 4,553,730 | A | 11/1985 | Vivic | |
| 4,699,350 | A | 10/1987 | Herve | |
| 4,986,511 | A | 1/1991 | Irby et al. | |
| 5,044,602 | A | 9/1991 | Heinonen | |
| 5,044,603 | A | 9/1991 | Granger et al. | |
| 5,125,620 | A | 6/1992 | Young | |
| 5,180,137 | A | 1/1993 | Carlson et al. | |
| 5,294,088 | A | 3/1994 | McWhorter et al. | |
| 5,713,581 | A | 2/1998 | Carlson et al. | |
| 5,743,332 | A | 4/1998 | Lam et al. | |
| 5,765,813 | A | 6/1998 | Lam et al. | |
| 5,944,110 | A | 8/1999 | Watts et al. | |
| 6,176,466 | B1 | 1/2001 | Lam et al. | |
| 6,367,804 | B1 | 4/2002 | Watts | |
| 6,394,460 | B1 | 5/2002 | Leggett et al. | |
| 6,457,530 | B1 | 10/2002 | Lam et al. | |
| 6,595,278 | B1 | 7/2003 | Lam et al. | |
| 6,719,262 | B2 | 4/2004 | Whitby | |
| 6,877,712 | B2 | 4/2005 | Wiedemann | |
| 7,010,844 | B2 | 3/2006 | Pekarsky | |
| 7,137,610 | B2 | 11/2006 | Lam | |
| 7,552,765 | B2 | 6/2009 | Lam | |
| 7,673,674 | B2 | 3/2010 | Lam | |
| 7,703,739 | B2 | 4/2010 | Judge et al. | |
| 7,717,433 | B2 | 5/2010 | Taylor et al. | |
| 8,783,643 | B2 * | 7/2014 | Guo et al. | 251/1.3 |
| 8,807,516 | B2 * | 8/2014 | Guo et al. | 251/1.3 |
| 2006/0038147 | A1 | 2/2006 | Urrutia | |
| 2007/0175625 | A1 | 8/2007 | Lam | |
| 2007/0175626 | A1 | 8/2007 | Lam | |
| 2011/0140013 | A1 | 6/2011 | Guo et al. | |

* cited by examiner

BLOWOUT PREVENTER AND RAMS

CROSS-REFERENCE TO RELATED APPLICATIONS

This application is a Continuation of U.S. patent application Ser. No. 13/472,997, filed May 16, 2012, which is a Continuation-In-Part of U.S. patent application Ser. No. 12/967,421, filed Dec. 14, 2010, which claims priority from U.S. Provisional Patent Application No. 61/286,508 filed Dec. 15, 2009. All of these applications are incorporated by reference herein to the extent that there is no inconsistency with the present disclosure.

BACKGROUND OF THE INVENTION

Wellhead blowout preventers are used in oil wellhead assemblies to seal against a central bore. In a pumping production wellhead, the blow out preventer (BOP) may be configured to seal against a polish rod or a tubular member if present. The rams of a BOP may operate in different ways in closing off a well, or multiple BOPs may be used in a wellhead stack to provide different functions. In a production pumping well, opposing polish rod BOP rams accommodate and seal around a polish rod extending generally vertically through the wellhead. Blind BOP rams seal against each other across the central bore when no polish rod is in place.

A typical prior art BOP for a production wellhead is disclosed in U.S. Pat. No. 5,765,813 to Lam et al., issued Jun. 16, 1998, owned by Stream-Flo Industries Ltd., the assignee of this patent application. This type of BOP is commonly used in connection with pumping production wells. With such wells, a sucker rod string is reciprocated or rotated to drive a downhole pump, which lifts the produced fluid to the surface through a tubing string. The BOP is equipped with a pair of opposing polish rod rams which can be advanced horizontally to seal around the vertical polish rod portion of the rod string to prevent the upward escape of fluid. Alternatively, if the rod string is out of the well, the inner or front ends of the rams can be pressed together to cause closure of the wellhead assembly fluid passageway.

More particularly, a typical pumping production BOP includes a cross-shaped housing forming a central, generally vertical bore and a pair of coaxial, horizontal ram bores intersecting the central bore from each side. The BOP is commonly positioned in the wellhead assembly between the tubing head and flow tee. In this configuration, the central bore of the BOP forms part of the wellhead assembly fluid passageway. Within the BOP, a pair of rams is positioned in the horizontal ram bores. Actuator mechanisms, which generally include rams screw powered by mechanical, electrical, pneumatic or hydraulic actuators, are provided at the outer ends of the ram bores, for extending or retracting the rams into or out of the central bore, in order to close or open the central well bore. Each BOP ram comprises a generally cylindrical body, although other shaped ram bodies are known (ex. oval, rectangular or square in cross section). The ram generally comprises a steel core, preferably having an outer full bore diameter portion (or rear portion) and a reduced diameter inner portion (or front portion). The ram core inner portion is covered with and bonded to a layer of an elastomeric material, typically a nitrile rubber. The ram bores, typically cylindrical, extend into the central bore and the bore surfaces combine at their intersection to form sealing areas. When the rams move into the central bore, the rubber surfaces of their inner portions seal against the sealing surfaces.

The rubber-coated inner or front face of each ram is typically formed to provide a semi-circular, vertically directed groove, also termed vertical radial groove. When the polish rod of the rod string is present in the central bore, opposing ram ends encircle and press against the polish rod to form a seal of the central bore. When the polish rod is not present the ram ends compress together to form a solid block. In both cases, the circumferential seals of the ram side surfaces, with the sealing areas and the end face seals, combine to close the central bore and contain pressurized fluids.

U.S. Pat. No. 7,673,674, issued Mar. 9, 2010 to Tony M. Lam, and assigned to Stream-Flo Industries Ltd., the assignee for this patent application, describes a BOP ram and/or polish rod claim in which the vertically directed groove at the front face of the ram is shaped as a V-groove to accommodate a portion of the circumference of the polish rod. U.S. Pat. No. 7,552,765 to Tony M. Lam, issued Jun. 30, 2009, and assigned to Stream-Flo Industries Ltd., describes a BOP in which one of the rams is formed with an extended central bore sealing section behind the front sealing end of the ram, such that the extended central bore sealing section can be extended across the central bore to seal the central bore when the polish rod is not present.

In a production BOP, pressure acting from below on the closed BOP rams may extrude the side rubber upwardly so that the circumferential seal with the sealing areas is lost. As well, the end rubber bonded to the vertical end faces (front faces) of the ram cores may tear loose from the core when high pressure is exerted from below. In severe conditions, such as injecting chemicals to close off a well, the rubber degrades quickly, causing the seals to fail. A large number of BOP ram designs exist to address problems of extrusion, tearing or degradation of the BOP ram seals.

Canadian Patent Application No. 2,260,655, published Aug. 2, 2000 naming Tony M. Lam and Keith D. Farquharson as inventors and Stream-Flo Industries Ltd. as assignee, describes a ram type BOP for high temperature applications. The BOP incorporates a generally L-shaped seal element formed of a graphite or asbestos seal material, which is sandwiched between a bottom L-shaped steel retainer plate and a semi-cylindrically shaped steel top retainer plate. This design of BOP ram is well suited for brittle seal materials such as graphite and asbestos when higher temperatures are encountered.

Other ram type BOP devices exist which use graphite or asbestos type seals or seal inserts. However, graphite and asbestos type sealing materials typically include polymeric bonding materials which have lower temperature limits than graphite or asbestos, so the seals are prone to failure at very high temperatures, such as temperatures above 600° F. Today, high temperature wellhead applications such as steam injection may require the wellhead equipment to accommodate temperatures above 600° F. Also, the use of asbestos seal materials is being phased out in industry due to harmful effects of asbestos fibres in handling, manufacture and in use.

Thermoplastic materials having superior chemical resistance are available, but have different compressibility and elastic properties than elastomeric sealing materials such as nitrile rubbers. Thus, BOP devices are not generally amenable to simple substitution of thermoplastics for the rubber sealing components. U.S. Pat. No. 7,137,610, issued to Lam on Nov. 22, 2006, and assigned to Stream-Flo Industries Inc., describes a production BOP and BOP rams incorporating thermoplastic seals at the front of the rams to seal against the polish rod. However, even thermoplastic materials have temperature limits below the temperatures encountered for steam injection wellheads.

In spite of the above advances in BOP ram seals, there is still a need for BOP devices capable of withstanding very high or very low temperature environments. For instance, in wellheads through which steam is injected to enhance recovery in depleted wells or for heavy oil wells, temperatures in excess of 650° F. can be reached. These temperatures far exceed the limits of nitrile rubber seals, elastomeric seal materials, and thermoplastic seal materials. As above, BOP devices adapted to carry graphite or asbestos seals are also subject to failure at such extreme temperatures as polymeric bonding materials in the seals begin to break down. As well, at very low temperatures, conventional BOP sealing materials become very hard or brittle, interfering with the ability to make reliable seals.

There is a still a need for a ram type BOP which can reliably seal against a polish rod and/or the central bore of a wellhead in very high temperature and very low temperature applications.

SUMMARY OF THE INVENTION

In one broad aspect, there is provided a ram type blowout preventer such as may be used in a pumping production well. The blowout preventer includes:

a) a housing forming a central bore extending generally vertically through the housing, and a pair of ram bores extending radially outwardly in opposite directions through the housing and intersecting the central bore;

b) a steel bodied ram positioned in each of the pair of ram bores to provide opposing rams, the ram having a front end portion, a rear end portion, a top portion and a bottom portion and being adapted for sliding movement in the ram bore between an extended position, with the front end portion extending across the central bore and the rear end portion within the ram bore, and a retracted position within the ram bore, the ram being configured with a front face to seal against the front face of the opposing ram and to accommodate and seal against a tubular member or rod, if present in the central bore;

c) a ram actuating mechanism connected to the rear end portion of the ram for extending and retracting the ram between the extended and retracted positions;

d) a seal on the ram, the seal extending across the front face, then rearwardly, and then either upwardly over the top portion or downwardly over the bottom portion, at a position rearwardly of the front end portion; and e) the front face of the ram forming a leading edge portion located either above or below the seal so that, as the opposing rams are moved into the extended position, the leading edge portions of the opposing rams abut and press against each other, imparting a generally vertical movement to the opposing rams to bring the seals on the front faces into sealing engagement with each other and to energize the seals extending over the top portion or the bottom portion against the ram bores;

f) whereby, in the extended position, the seals on the opposing rams seal against each other, against the tubular member or rod if present, and also seal the central bore.

In some embodiments, the front face of the ram includes an inclined portion such that a plane through the inclined portion is inclined toward the central bore, and the inclined portion is adapted to be brought into contact with the inclined portion on the opposing ram by the generally vertical movement imparted to the opposing rams. In this embodiment, the seal may be located on the inclined portion of the ram such the seals on the front faces of the opposing rams seal against each other as the inclined portions of the rams contact each other.

In some embodiments, the ram actuating mechanism includes a ram screw connected to the rear end portion of the ram at a point either above or below a center axis of the ram bore to facilitate imparting the generally vertical movement to the ram in the extended position.

In some embodiments, the front face of the ram may be formed with a cut away portion located above or below the seal to allow the ram to flex in the ram bore. In some embodiments the cut away portion is a horizontal slot extending across the front face and rearwardly in the ram.

In some embodiments the front face of the ram may form the inclined portion in a manner such that a plane through the front face is inclined top to bottom toward the central bore, and such that the leading edge portion is formed adjacent the top portion of the ram.

In other embodiments, the leading edge portion on the front face of the ram is a flattened planar portion formed adjacent either the top portion or the bottom portion of the ram, such that a plane through the flattened portion is generally vertical.

The seal of the blowout preventer may be formed as an elastomeric, a thermoplastic seal, or a rope packing seal. For a rope packing seal, the seal may be formed from a length or a loop of a rope packing material which can accommodate very high and/or very low temperatures. The seal may be formed as a primary rope packing seal formed from a first length or loop of rope packing extending across the front face, then rearwardly, and then upwardly over the top portion of the ram at a position rearwardly of the front end portion of the ram, with the primary rope packing seal being held in, so as to protrude radially outwardly from, a continuous first groove formed in the ram.

In some embodiments, the blowout preventer includes a primary rope packing seal which extends across the front face of the ram with a vertical offset relative to the primary rope packing seal on the front face of the opposing ram, such that in the extended position, the primary rope packing seals on the opposing rams seal against each other but with the vertical offset.

In some embodiments, the blowout preventer may include a secondary rope packing seal formed on the ram from a second length or loop of rope packing extending across the front face, and being spaced from the primary rope packing seal. The secondary rope packing seal is held in, so as to protrude radially outwardly from, a second groove formed in the ram. The secondary rope packing seal may extend across the front face of the ram with a vertical offset relative to the secondary rope packing seal on the front face of the opposing ram, such that in the extended position, the secondary rope packing seals on the opposing rams seal against each other but with the vertical offset.

In another broad aspect, there is provided a ram type blowout preventer which includes:

a) a housing forming a central bore extending generally vertically through the housing, and a pair of ram bores extending radially outwardly in opposite directions through the housing and intersecting the central bore;

b) a steel bodied, full bore ram positioned in each of the pair of ram bores to provide opposing rams, the ram having a front end portion, a rear end portion, a top portion and a bottom portion and being adapted for sliding movement in the ram bore between an extended position, with the front end portion extending across the central bore and the rear end portion within the ram bore, and a retracted position within the ram bore, the ram being configured with a front face to seal against the front face of the opposing ram and to accommodate and seal against tubular member or rod, if present in the central bore;

c) an actuating mechanism connected to the rear end portion of the ram for extending and retracting the ram between the extended and retracted positions, d) each ram comprising:

i. a body component forming the bottom portion of the ram, the body component having a front portion, a rear portion, a front end and a rear end;

ii. a seal component forming the top portion of the ram and extending rearwardly of the front end portion of the ram, the seal component having a front portion, a rear portion, a front end, a rear end, and a front face;

iii. the body component having a cut-out in its front portion to provide a seal support surface to support the seal component, the seal support surface being inclined front to rear such the seal component rides upwardly and rearwardly on the seal support surface;

iv. the seal component having an inner surface which generally conforms to the seal support surface of the body component;

v. the body component and seal component combining, in an assembled form, to form the full bore ram, which when out of the extended position has the front end of the seal component forming a leading edge portion which protrudes a horizontal distance beyond the front end of the body component; and vi. connectors for connecting the seal component and the body component while allowing the seal component, in the extended position, to be pressed against the seal support surface of the body component and to ride upwardly and rearwardly on the seal support surface; and e) a primary rope packing seal formed on the seal component of the ram from a first length or loop of rope packing, the primary rope packing seal extending across the front face of the seal component, rearwardly, and then upwardly over the top portion of the ram at a position rearwardly of the front end portion of the ram, the primary rope packing seal being held in, so as to protrude radially outwardly from, a continuous first groove formed in the seal component;

f) such that, in the extended position, the primary rope packing seals on the opposing rams seal against each other, against the tubular member or rod if present, and also seal the central bore.

The front face of the BOP ram may be formed with a vertical groove to accommodate a polish rod or other tubular member. In some embodiments the vertical groove is a radial groove. In other embodiments the vertical groove is a V-groove with the seal(s) extending across a raised radial backing section formed in the V-groove to seal to the tubular member or rod. In yet other embodiments the front face of the BOP ram body is formed as a blind ram to seal against an opposing ram without the polish rod.

The blowout preventer of any of these embodiments may be configured as a wellhead assembly which may include the BOP alone, or in a stack with one or more other wellhead components. The blowout preventer of any of these embodiments may alternatively be included in a wellhead assembly provided as an integral composite assembly with one or more other wellhead components which might include, in any sequence, adaptors, control valves, additional BOPs, check valves, a flow tee, and a polish rod clamp. The wellhead assembly of any of these embodiments includes top and bottom connectors for connecting to wellhead components located above and below. Such connectors may be of any type, as is known in the industry, including for example studded connectors, flange connections, welded connections, clamp and threaded connections. Also provided are the BOP rams configured as set out for any of the embodiments described herein.

The rams and ram bores may be of any shape or configuration as is known in the BOP industry. While the figures show the rams and ram bores as being cylindrical in cross-section, they may be alternatively shaped, such as oval in cross section. As used herein, the term "cylindrical" is understood to include rams and ram bores which are generally circular or oval in cross section.

It should be understood that the terms "front", "rear", "upper", "lower", "inner", "outer", "top" and "bottom", as used herein and in the claims with reference to the wellhead components and the BOP ram or its parts, refer to the component or ram as it is designed to be positioned in one of the horizontal ram bores, for longitudinal movement forwardly into the central bore or rearwardly in the horizontal ram bores. By "front", as used herein, is meant the portion or end of the ram or its parts at the central bore, or that is facing the central bore. By "rear" is meant the portion or end of the ram or its parts opposite the front. By "outer" is meant the outer circumferential portion of the ram or its parts. The term "central" in reference to the "central bore" is meant to include a generally vertical well bore which may be somewhat off-center in the wellhead assembly, or somewhat inclined relative to vertical, such as occurs in horizontal or inclined oil/gas wells. Thus the term "generally vertical", or "vertical" is meant to include well bores that are inclined relative to vertical, and wellhead components configured to accommodate such configurations. Similarly, the term "horizontal ram bore" is meant to include generally horizontal ram bores which intersect the central bore at angles generally perpendicular to the longitudinal axis of the central bore.

As used herein and in the claims, a reference to "a connection," "connected" or "connect(s)" is a reference to a sealed pressure-containing connection unless the context otherwise requires.

As used herein, "comprising" is synonymous with "including," "containing," or "characterized by," and is inclusive or open-ended and does not exclude additional, unrecited elements or method steps. The invention illustratively described herein suitably may be practiced in the absence of any element or elements, limitation or limitations which is not specifically disclosed herein.

The use of the indefinite article "a" in the claims before an element means that one of the elements is specified, but does not specifically exclude others of the elements being present, unless the context clearly requires that there be one and only one of the elements.

DETAILED DESCRIPTION OF THE INVENTION

Figure 1:
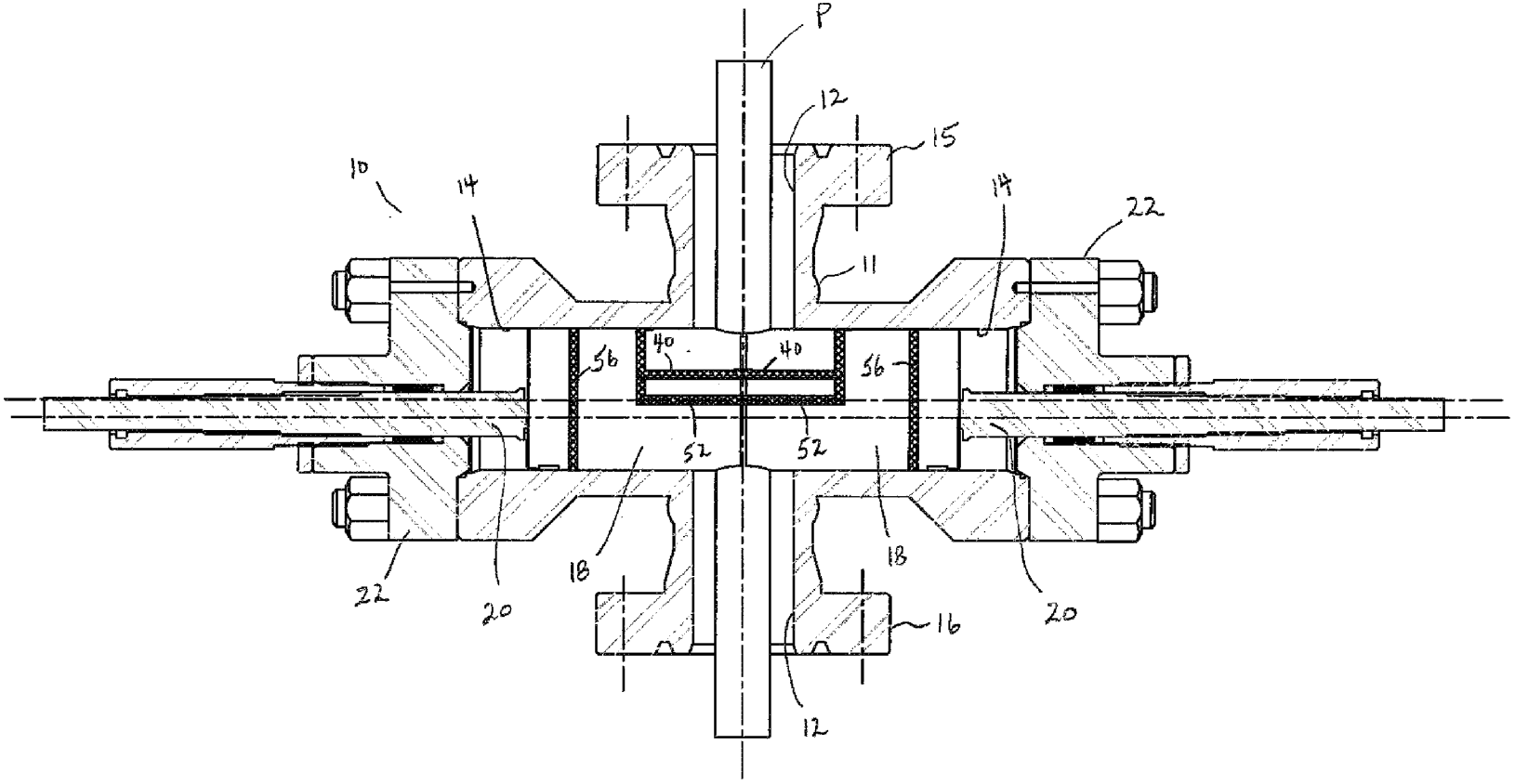
FIG. 1 is a side view of one embodiment of a production blowout preventer (BOP) showing the housing, end plugs and ram screws in section, and showing both of the BOP rams in an extended sealing position against a polish rod.

Multiple embodiments of a production blowout preventer (BOP) and BOP rams adapted for a production pumping BOP are shown in the Figures, with like parts being labeled with the same reference numerals. In FIGS. 1-13, the BOP rams are configured with generally parallel planar front faces, and provide primary rope packing seals, and optionally secondary rope packing seals and circumferential rope packing seals. In FIGS. 14-23, the BOP rams may be configured with a leading edge portion at the front faces of the opposing rams to abut and press against each other in the extended position so as to impart a generally vertical movement to the opposing rams. Alternatively, or in addition, the BOP rams of FIGS. 14-23 may be configured such that the seals across the front faces of the opposing rams have a vertical offset such that the seals seal against each other, but with the vertical offset.

Having reference to FIG. 1, a production blowout preventer (BOP) is shown generally at 10, to include a cross-shaped, pressure-containing steel housing 11 forming a central bore 12, extending generally vertically through the housing 11, and a pair of co-axial horizontal ram bores 14. The ram bores 14 are slightly larger in diameter than the central bore 12, as is common in BOP devices. Top and bottom flange connectors 15, 16 to wellhead components located above and below the BOP 10 are shown, although alternate top and bottom connectors such as threaded, welded, studded, or clamp connections may be used. The horizontal ram bores 14 intersect with the central bore 12. The polish rod P is shown in place in the central bore 12. The polish rod P is an example of a tubular member which may be present in the central bore.

A pair of generally cylindrical BOP rams 18 are shown in FIG. 1. Each of the rams 18 may be formed in multiple parts, but are generally cylindrically shaped when assembled for close fitting relationship in, and optionally for sealing to, the ram bores 14. The rams 18 are generally formed as steel bodied rams. The rams 18 are locked onto the ends of ram screws 20, which extend through end plugs or bonnets 22 at the outer ends of the ram bores 14. The ram screws 20 can be turned to extend or retract the rams 18 into or out of the central bore 12 with mechanical screw jacks (not shown). The ram screw 20 is connected at the rear face 33 of the ram 18, typically in a T-slot 35 (see FIG. 4), in a manner known in the art. Alternatively, the ram screws 20 can be extended and retracted with hydraulic actuators (not shown), as known in the art. It should be understood that the rams 18 may be alternately actuated, for instance by pneumatic or electrical actuators. Actuators may be single or double acting, as known in the art. Any of these mechanical screw jacks or alternate actuators thus illustrate actuators or ram actuating mechanisms for extending and retracting the rams 18 between their open position, in which the rams 18 are retracted from the central bore 12, and the closed, sealing position, in which the opposing rams 18 are extended to seal around the polish rod P, and thus to seal the central bore from pressure below.

It should be understood that one of the rams, along with the ram bores, may be adapted to include and accommodate an extended central bore sealing section as described in U.S. Pat. No. 7,552,765.

It should be understood that the ram bores 14 and corresponding rams 18 are not necessarily strictly cylindrical in shape. The rams and bores may take alternate shapes, such as oval in cross section, as is known in the art.

Figure 2:
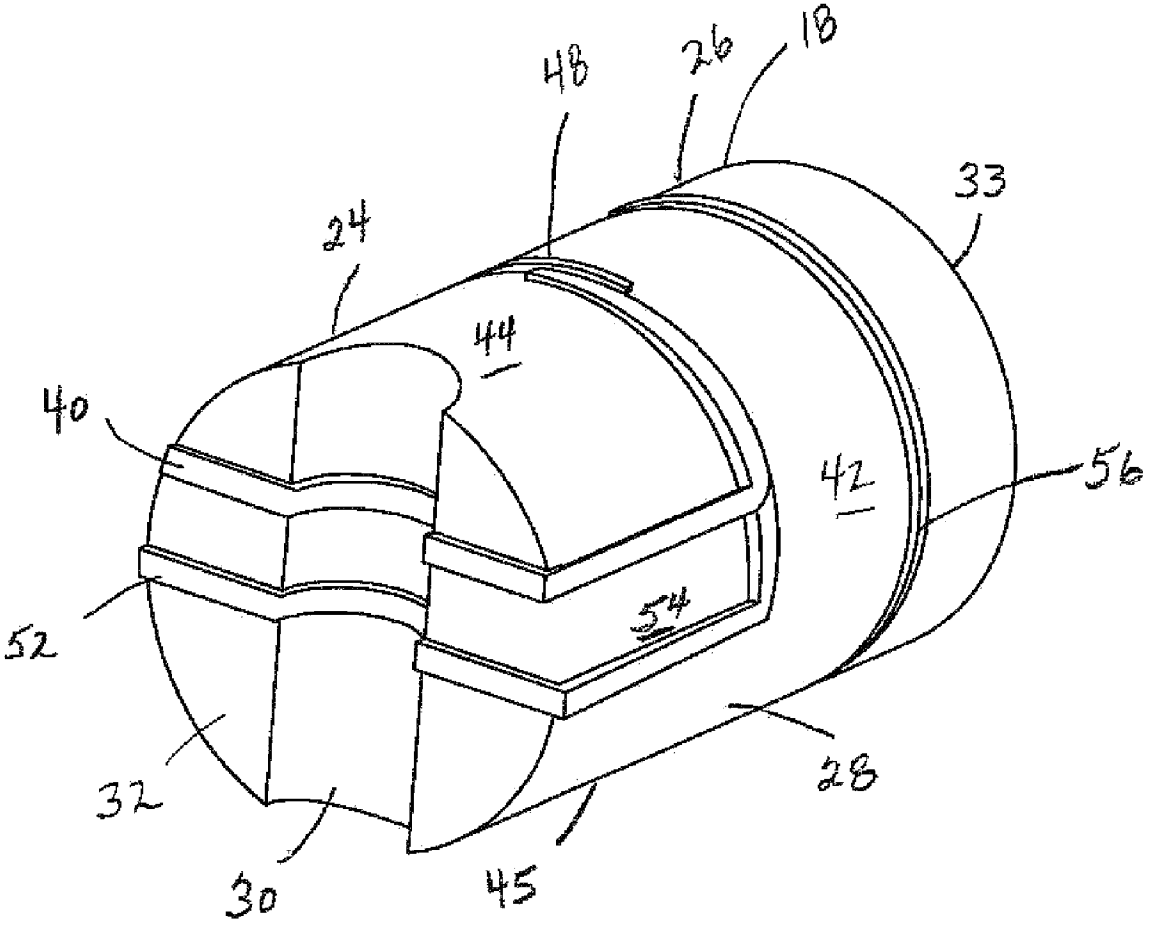
FIG. 2 is a perspective view of one of the BOP rams from FIG. 1, formed with a radial vertical groove at its front face to accommodate a polish rod, and showing a primary rope packing seal, a secondary rope packing seal spaced from the primary rope packing seal, and a circumferential rope packing seal formed rearwardly of the primary and secondary rope packing seals. Each rope packing for these seals is held in continuous grooves formed in the ram.
Figure 3:
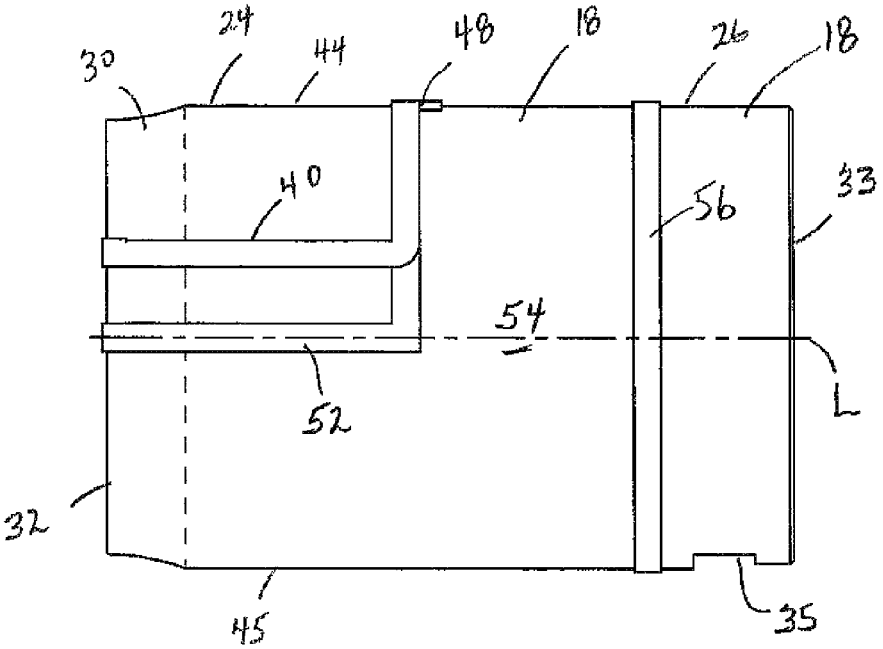
FIG. 3 is a side view of the BOP ram of FIG. 2.
Figure 4:
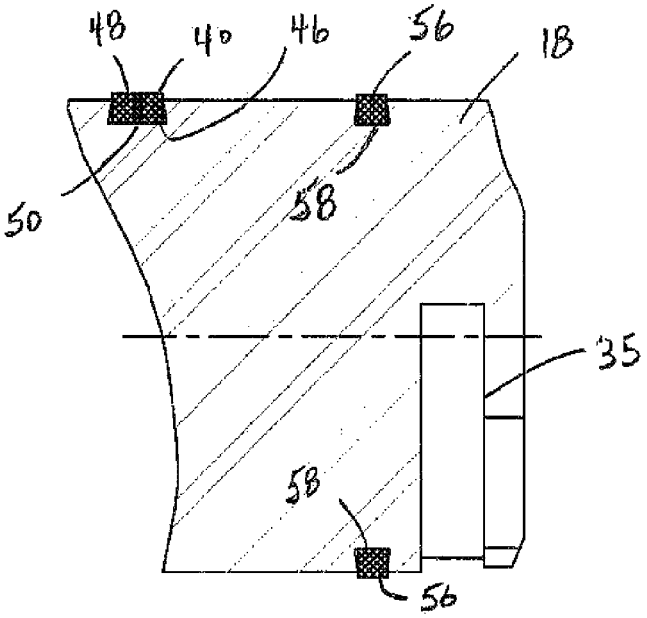
FIG. 4 is side sectional view along line 4-4 of FIG. 6, partially cut away, showing the overlapping ends of the primary rope packing seal at the top portion of the ram, and also showing a central T-slot at the rear of the ram to lock onto the ends of a ram screw used to extend and retract the ram.
Figure 5:
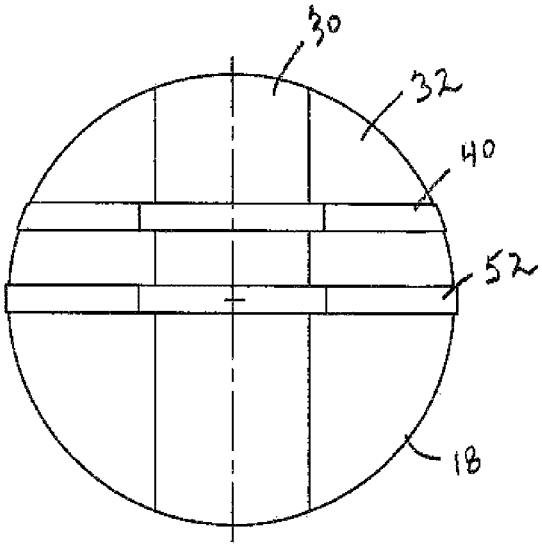
FIG. 5 is a partial front view of the ram of FIG. 2 showing the primary and secondary rope packing seals extending across the vertical radial groove.
Figure 6:
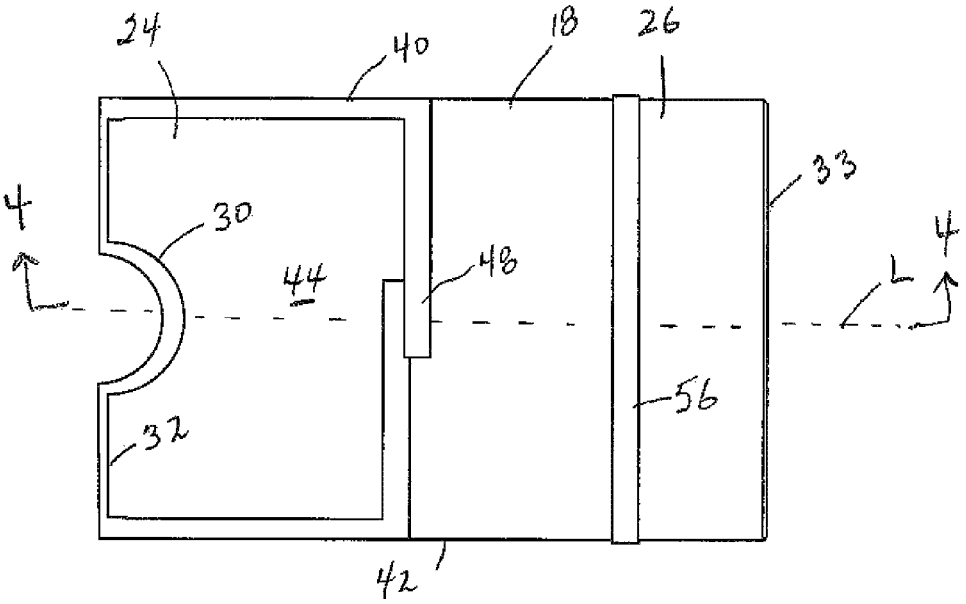
FIG. 6 is a top view of the ram of FIG. 2, showing the primary rope packing seal overlapping ends at the top portion of the ram.

A first embodiment of a ram 18 is shown in FIG. 2. In FIG. 1, this first embodiment of a pair of rams 18 are shown in their fully extended, sealing position, with opposing front faces 32 (see FIG. 2) sealed against each other, against the polish rod P, and against the central bore 12. The seal arrangement is one in which the rams 18 carry seals adapted to seal the central bore 12 against pressure from below. However, it should understood that the rams 18 may be rotated or configured in a different manner. For example, a ram which is rotated 180° compared to FIG. 1, will seal the central bore 12 against pressure from above. A ram which carries additional mirror image seals on the bottom portion of the ram, compared to FIGS. 1 and 2, will seal the central bore 12 against pressure from above and below. Thus, while embodiments are described which seal against pressure from below, these are only exemplary, and not limiting, embodiments.

Each ram 18 includes a front end portion 24 (this being the portion which extends into the central bore 12 in the extended position) and a rear end portion 26 (facing the end plugs 22, and which remains within the horizontal ram bore 14 in the retracted and extended positions). The ram bores 14 are each of sufficient length to accommodate the ram 18 in its fully retracted, open position or its fully extended, sealing position.

Each ram 18 is formed from a steel body component 28 which is generally cylindrical in shape for a tight fitting seal in the ram bore 14. The body component 28 may be formed in multiple components which are assembled to form a cylindrical ram, but a single piece steel body component is shown in the FIGS. 1-22.

Figure 7:
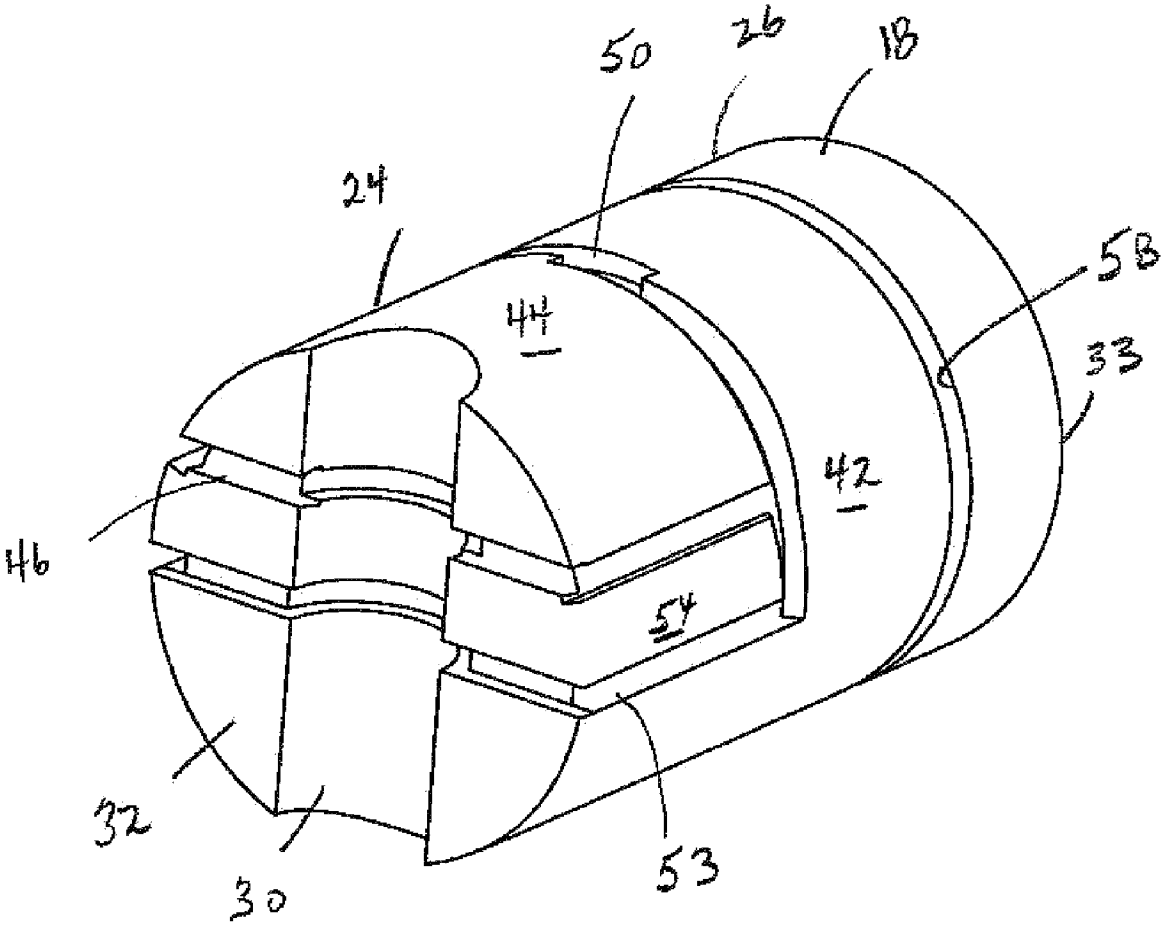
FIG. 7 is a perspective view of the ram of FIG. 2, with the primary and secondary rope packing seals removed, showing the dove-tail shaped grooves to retain the lengths of rope packings.
Figure 8:
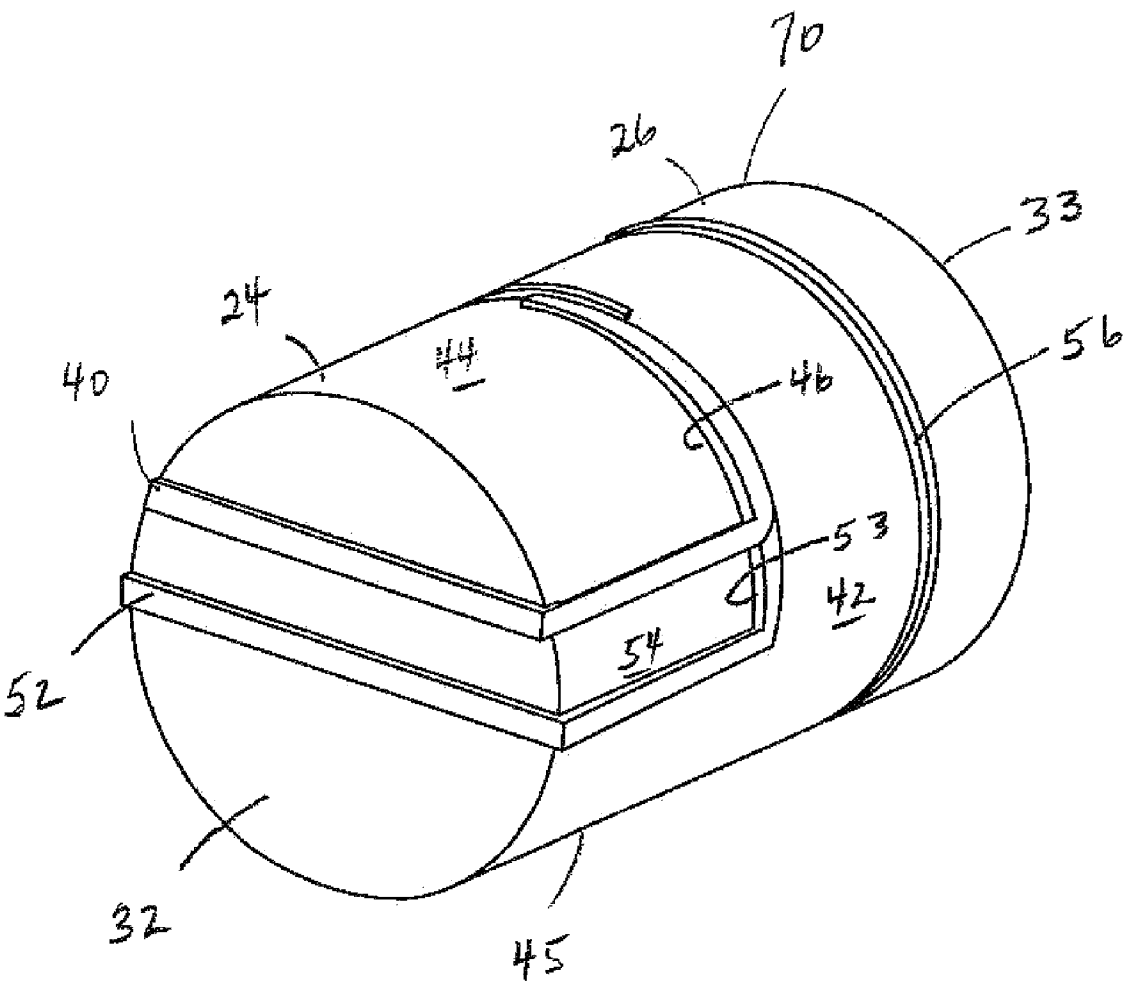
FIG. 8 is a perspective view of a further embodiment of a BOP ram having a blind front face for sealing across the central bore when a polish rod is not present, and incorporating primary and secondary rope packing seals.
Figure 9:
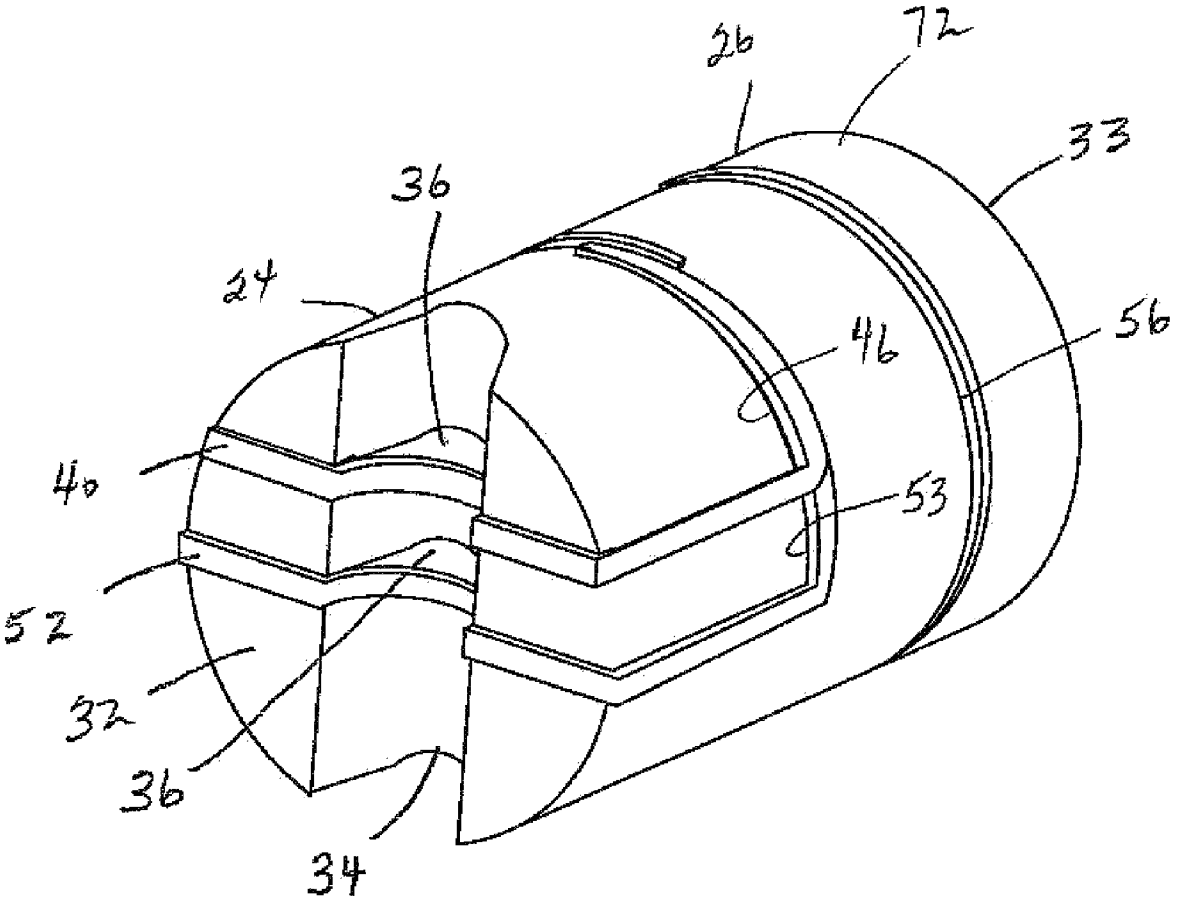
FIG. 9 is a perspective view of a further embodiment of a BOP ram having a V-shaped vertical groove at its front face, and including the primary and secondary rope packing seals extending across a raised radial backing section formed in the V-grove to seal the polish rod.

The ram 18 is formed with a vertical groove 30 that runs along the front face 32 of the ram 18 to accommodate the polish rod P or other tubular member. In FIGS. 2, 3, 5, 6, 7 and 10, the vertical radial groove is shown as generally semicircular (in horizontal cross section). The vertical groove 30 may be omitted if the front ends of the rams 17, 18 are to function as blind rams 70 to seal against each other in the event that the polish rod is not present, as shown in FIG. 8. Still alternatively, the vertical groove may take the form of a vertical V-groove 34 running along the front face 32, as shown in FIG. 9, and as described in U.S. Pat. No. 7,673,674. The V-groove 34 is sized to accommodate at least a portion of the circumference of the polish rod within the groove 34. In the V-groove embodiment of FIG. 9, one or more radial shaped, raised backing sections 36 (two shown in FIG. 9) are formed at sealing locations within the V-groove, these backing sections being sized to accommodate the polish rod P in a tight fitting relationship.

Figure 10:
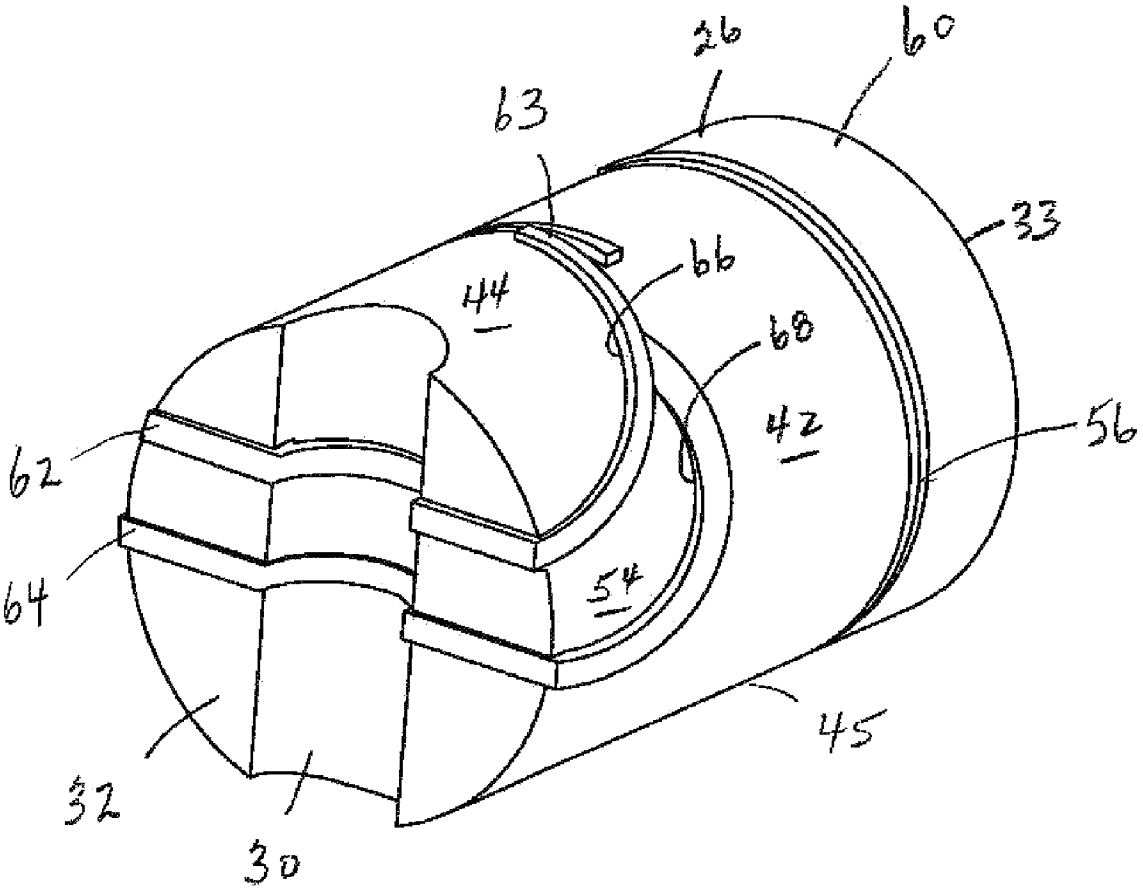
FIG. 10 is a perspective view of a further embodiment of a BOP ram having an alternate spacing arrangement of the primary and secondary rope packing seals.
Figure 11:
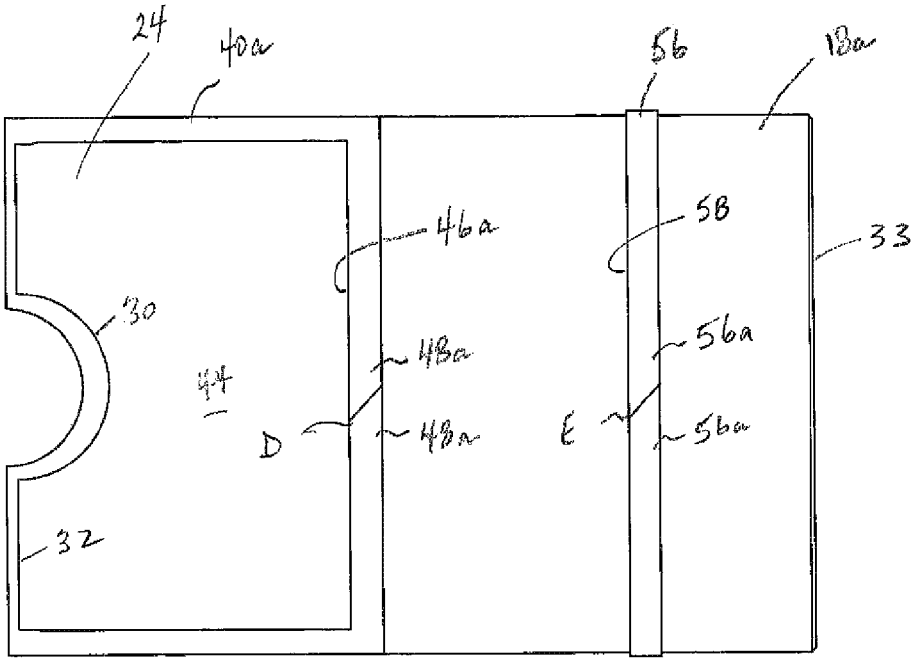
FIG. 11 is a top view of a further embodiment of a BOP ram, showing joined abutting ends of the primary rope packing seal and the circumferential rope packing seal, with the joined abutting ends both being located at the top portion of the ram.

As shown in FIG. 2, each of the rams 18 include at least one rope packing seal, shown as primary rope packing seal 40. The primary rope packing seal 40 is formed from a length of rope packing which forms a closed loop on the outer surface of the ram 18. The length of rope packing, and thus the primary rope packing seal 40 extends horizontally across the front face 32 of the ram 18, including across the vertical groove 30, then generally rearwardly, and then upwardly around a portion of the outer surface of the ram 18 and over the top portion 44 of the ram 18. Although not shown, the primary rope packing seal 40 could alternatively, or in addition, extend over the bottom portion 45 of the ram 18. In order to seal the central bore 12, the location where the primary rope packing seal 40 extends over the top portion 44 (or bottom portion 45) is at a position on the ram 18 rearwardly of the front end portion 24, such that the seal 40 at the top portion 44 remains within the ram bore 14 when the ram 18 is fully extended (see FIG. 1), so as to seal to the ram bore 14. In FIG. 2, the primary rope packing seal 40 is shown to extend rearwardly along the side wall 42 of the ram 18, and then circumferentially upwardly across the top portion 44 of the ram 18. Alternatively, the primary rope packing seal could extend in an arcuate path, both rearwardly and upwardly, such as shown in FIG. 10 (labeled as primary rope packing seal 62, and described below). Thus the terms "rearwardly", "upwardly" and "downwardly" as used herein and in the claims with respect to the rope packing seals are not meant to refer to strict horizontal or vertical orientations, but are meant to include arcuate paths.

The primary rope packing seal 40 is preferably formed from a single length of rope packing. While multiple lengths could be used, a single length minimizes the number of joining ends to be accommodated, and thus minimizes weaknesses in the seal. The primary rope packing seal 40 is held within a continuous first groove 46 (see FIG. 7) machined into the steel body component 28 to underlie the path of the rope packing seal 40. For the rams 18 shown in FIGS. 1-10, the continuous first groove 46 is shown to be adapted to accommodate overlapping end portions 48 (overlapping ends) of the length of rope packing material in a manner to form a dynamic seal as the BOP ram 18 is extended or retracted in the ram bore 14. The overlap is shown in the Figures to be positioned at the top portion 44 of the ram 18, such that the overlapping ends 48 are positioned side by side, and are directed generally perpendicularly to the longitudinal axis L of the ram 18 (see FIG. 6). In this way, as the ram 18 is moved longitudinally along its axis L, the overlapping end portions 48 are compressed together by the extending/retracting movement of the ram 18. This is preferable to locating overlapping end portions at a position such that they are parallel to the longitudinal axis of movement of the rams 18, since parallel overlapped ends may tend to be pulled apart by the extending/retracting movement of the ram 18. To accommodate the overlapping side by side end portions 48, the continuous first groove 46 is machined, preferably at the top portion 44, with a widened groove portion 50 (see FIGS. 4 and 7) sized to accommodate two diameters of the overlapping ends 48 of the rope packing material in a compressed manner as the overlapping ends 48 lie side by side. This side by side overlapping ends 48 arrangement is shown within the widened groove portion 50 in FIGS. 4 and 6.

Alternatively, a continuous first groove may be formed to accommodate joined abutting ends of the rope packing. This is shown as a top view in the embodiments of rams 18*a*, 18*b* and 18*c* in FIGS. 11-13. In these Figures, the primary rope packing seal is shown at 40*a*, in a continuous first groove 46*a* (without a widened portion), but with the ends 48*a* of the rope packing being cut on a diagonal angle, for example a 45° angle, at D such that they join (i.e., meet) with each other as joined abutting ends 48*a* within the groove 46*a*. As above, the joined abutting ends 48*a* are preferably joined at a location such that the ends are directed generally perpendicularly to, or diagonally across, the longitudinal axis of the ram. This minimizes pulling apart action on the ends 48*a* as the ram 18*a*, 18*b*, 18*c* is extended and retracted in the ram bores 14.

The continuous first groove 46 is preferably sized with a depth dimension which is slightly undersized relative to the diameter or side dimension of the rope packing. The opening dimension of the continuous first groove 46 may also be undersize relative to the diameter or side dimension of the rope packing. Either or both of these techniques assist with the rope packing being held in the groove 46, while protruding radially from the groove 46, to provide the seal to sealing surfaces of the housing 11. A dove-tail shaped groove shape (see cross section of groove in FIG. 4) is particularly preferred to hold and retain the rope packing against dislodging. The groove 46 is best illustrated in FIG. 7, in which the rope packing seal 40 is removed. A "dove-tail shaped" groove is a groove which, in cross section, is sized smaller at its opening dimension than it is at the bottom wall dimension of the groove, for example generally trapezoidal shaped. However, other groove shapes such as generally round or square (in cross section) may be used. Rope packing materials are particularly amenable to being compressed into grooves of different shapes, so as to be retained therein, while also protruding therefrom.

As shown in FIG. 2, the ram 18 may include a secondary rope packing seal 52. This secondary rope packing seal 52 has particular application in higher pressure sealing applications. The secondary rope packing seal 52 may be formed from a second single length of rope packing. The secondary rope packing seal 52 extends in a continuous length, horizontally across the front face 32 of the ram 18, including across the vertical groove 30 (preferably parallel and below the primary rope packing seal 40). The rope packing seal 52 then extends rearwardly along the side wall 42 of the ram body 28 (for example parallel and spaced below the primary rope packing seal 40), and upwardly to meet the primary rope packing seal 40. As shown in FIG. 7 (rope packing seals 40, 52 removed), the secondary rope packing seal 52 is held within a continuous second groove 53 machined into the steel body component 28 to underlie the secondary rope packing seal. The second groove 53 is preferably undersized in its depth dimension, and preferably dove-tail shaped, as set forth above for first groove 46 and/or 46*a*. At the point where the secondary rope packing seal 52 meets the primary rope packing seal 40, the grooves 53 and 46 are continuous with each other (see FIG. 7).

Alternatively, the secondary rope packing seal may extend rearwardly and then upwardly (or downwardly), spaced from the primary rope packing seal, and around the top portion or bottom portion of the ram to form a closed loop. In such embodiments, a continuous second groove adapted to hold the secondary rope packing seal is adapted to accommodate joined or overlapping ends of the rope packing as set out above for the primary rope packing seal.

In the Figures, the primary rope packing seal 40 is shown to extend rearwardly at a location which is above the central portion 54 of the ram 18 (i.e., above a central horizontal cross section line through the ram), and then over the top portion 44 of the ram 18. In this manner, upward pressure along the central bore 12 assists in sealing the ram 18 in its extended sealing position, as the primary rope packing seal 40 is radially compressed against the wall of the ram bores 14. The secondary rope packing seal 52 (if present), may be located horizontally below the primary rope packing seal 40, for example at or near the central portion 54 of the ram 18 (i.e., closer to a central horizontal cross section line through the ram). However, other locations of the rope packing seals 40, 52 are possible. For instance, if a bidirectional BOP sealing ram is needed, the BOP ram may be formed with a primary rope packing seal 40 such as shown in the Figures, located above the central portion 54 of the ram 18, and with a further rope packing seal (not shown) located as a mirror image below the central portion of the ram 18.

It should be also be apparent that the rams 18 as shown in the Figures could be rotated for positioning in the ram bores 14 such that the rope packing seals 40 and/or 52 are located below and at the central portion of the ram 18. Further, the rams 18 might be modified to include an upper rope packing (such as primary rope packing seal 40), a lower rope packing seal which may be a mirror image of the upper rope packing seal, and a central rope packing seal located horizontally between the upper and lower rope packing seals, and which extends upwardly and downwardly at its sides to join with the upper and lower rope packing seals.

Figure 12:
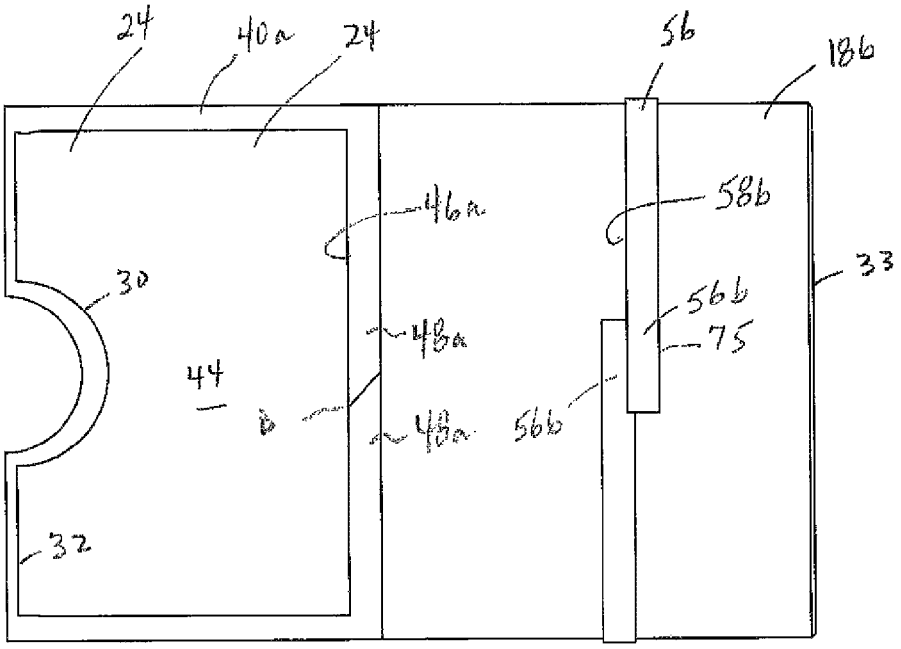
FIG. 12 is a top view of a further embodiment of a BOP ram, showing joined abutting ends of the primary rope packing seal, and overlapping ends of the circumferential rope packing seal, with the joined abutting ends and the overlapping ends being located at the top portion of the ram.
Figure 13:
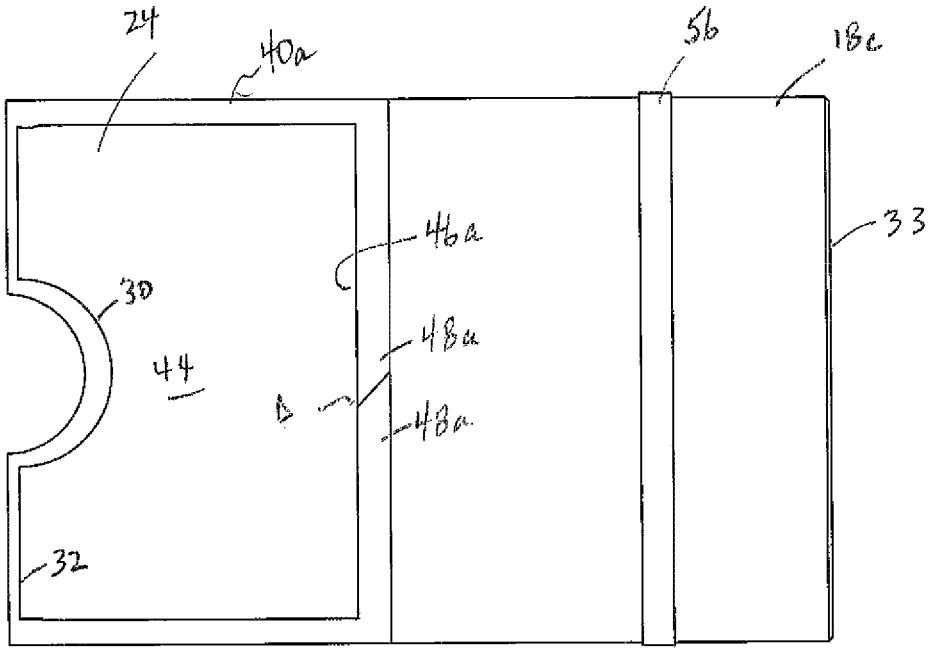
FIG. 13 is a top view of a further embodiment of a BOP ram, showing joined abutting ends of the primary rope packing seal at the top portion of the ram, and joined abutting ends of the circumferential rope packing seal located at the bottom portion of the ram.

The rear end portion 26 of the ram 18 may be formed with a circumferential seal 56 to seal the ram bores 14. In some BOP embodiments the end plugs or bonnet 22 may be used to seal the ends of the ram bores 14, so the circumferential seal 56 may be omitted in such embodiments. This circumferential seal 56 may be formed from a length of rope packing material to comprise a circumferential rope packing seal 56. The ram 18 may be formed with a continuous circumferential groove 58 at the rear end portion 26 to underlie the rope packing circumferential seal 56. The circumferential groove 58 may be formed to accommodate joined abutting ends 56*a* cut on a diagonal angle at E (not shown in FIG. 1-10 or 13, but shown at the top portion 44 of ram 18*a* in FIG. 11). Alternatively, as shown in FIG. 12 for ram 18*b*, the circumferential groove 58*b* may be formed with a widened portion 75 to accommodate overlapped ends 56*b* as described above for the primary rope packing seal 40. For the circumferential seal 56, the location of the widened portion or joined abutting ends is not critical, since the ends will be positioned perpendicular to the longitudinal axis of ram movement regardless of its location. In this way, the circumferential seal 56 also functions as a dynamic seal.

FIG. 10 illustrates alternate embodiment of a ram 60, in which the primary rope packing seal 62 extends horizontally across the front face 32, including across the vertical groove 30, and then extends rearwardly and upwardly along an arcuate path to meet at the top portion 44 of the ram 18, where overlapped end portions 63 are accommodated as described above. Similarly, the secondary rope packing seal 64 extends horizontally across the front face 32, including across the vertical groove 30, but spaced below the primary rope packing seal 62, and then extends rearwardly and upwardly along an arcuate path to meet the primary rope packing seal 62. The rope packings for these seals 62 and 64 are held in first, second grooves 66, 68 machined in the body component 28, and positioned to underlie the seals 62, 64.

In the embodiment of FIG. 8, the primary and secondary rope packing seals 40, 52 are as described above, but being a blind ram 70, no vertical groove is formed in the front face of the ram 70.

In the embodiment of FIG. 9, the primary and secondary seals 40, 52 are generally as described above for FIG. 2, but in a ram 72 formed with a vertical V-groove 34 to accommodate the polish rod P (not shown), the rope packing seals 40, 52 are formed on the radial backing sections 36, with the first and second grooves 46, 53 being machined horizontally across these backing sections 36. A circumferential seal 56 is formed in the rear portion 26, as described above for FIG. 2. Other aspects of the V-groove ram are more fully described in U.S. Pat. No. 7,673,674.

The rope packing seals may be made from any known rope packing seal materials. Rope packings are available in many different forms, for example, braided, twisted, woven and knitted. The rope packing may have a core material which differs or is the same as the outer sealing material in composition, for example higher temperature seal material may be used over a lower temperature core materials. As well, the rope packing may be reinforced, for example with wire reinforcing materials such as steel, copper or stainless steel. The cross sectional shape may vary, such as square, square with rounded corners, oval or circular, with square being preferred. The continuous groove in the rams can be varied to accommodate and hold different cross sectional shapes of rope packings. Examples of rope packings include braided cotton twill, braided ramie fibre, braided tallowed rayon, tallowed flax graphite, braided jute yarn, braided glass fibre, aluminum foil, braided copper wire, braided PTFE materials (polytetrafluoroethylene such as Teflon®), Teflon impregnated braided asbestos, braided ceramics, braided asbestos, and braided graphite. One exemplary material for very high temperature applications is graphite rope packing which is stainless steel reinforced, with a square cross section and a side dimension of about 0.8 cm. Diameters of rope packing ranging from about 0.5 cm to 2 cm may be used. The rope packing is threaded or pressed into the machined grooves 46, 53, 58 for example with a hammer, or other known rope packing threading tools/devices.

Each of the primary and circumferential rope packing seals (and in some embodiments the secondary rope packing seal), by being formed from a length of rope packing arranged as a closed loop, and being held in a continuous groove which accommodates either joined abutting ends, or overlapping ends in side by side relationship, is able to provide a dynamic seal on a blowout preventer ram.

In general, rope packings have been previously used only as static seals in the wellhead equipment, where the seal remains generally static during seal operation/energization. Examples of static rope packing seal applications include annular seals on rotating or translating pipes, shafts or stems (ex. stuffing box seals), or in place of O-ring seals on tubulars such as tubing hangers. The BOPs and rams described herein accommodate rope packings as a dynamic (moving) seal. This enables higher temperature rope packing materials to be used. For instance, graphite reinforced stainless steel rope packing materials have been rated up to about 1000° F., high enough for wellheads designed for steam injection or other very high temperature heating applications. Rope packing materials for very low temperature applications may also be accommodated.

In the embodiments shown in FIGS. 14-23, the rams are shown to be configured with front faces to abut and press against each other in the extended position so as to impart a generally vertical movement to the opposing rams. Alternatively, or in addition, the BOP rams shown in FIGS. 14-23 may be configured such that the seals across the front faces of the opposing rams have a vertical offset so that the front face seals seal against each other, but with this vertical offset. The multiple embodiments of FIGS. 1-23 are shown with like parts being labeled with the same reference numerals.

Figure 14:
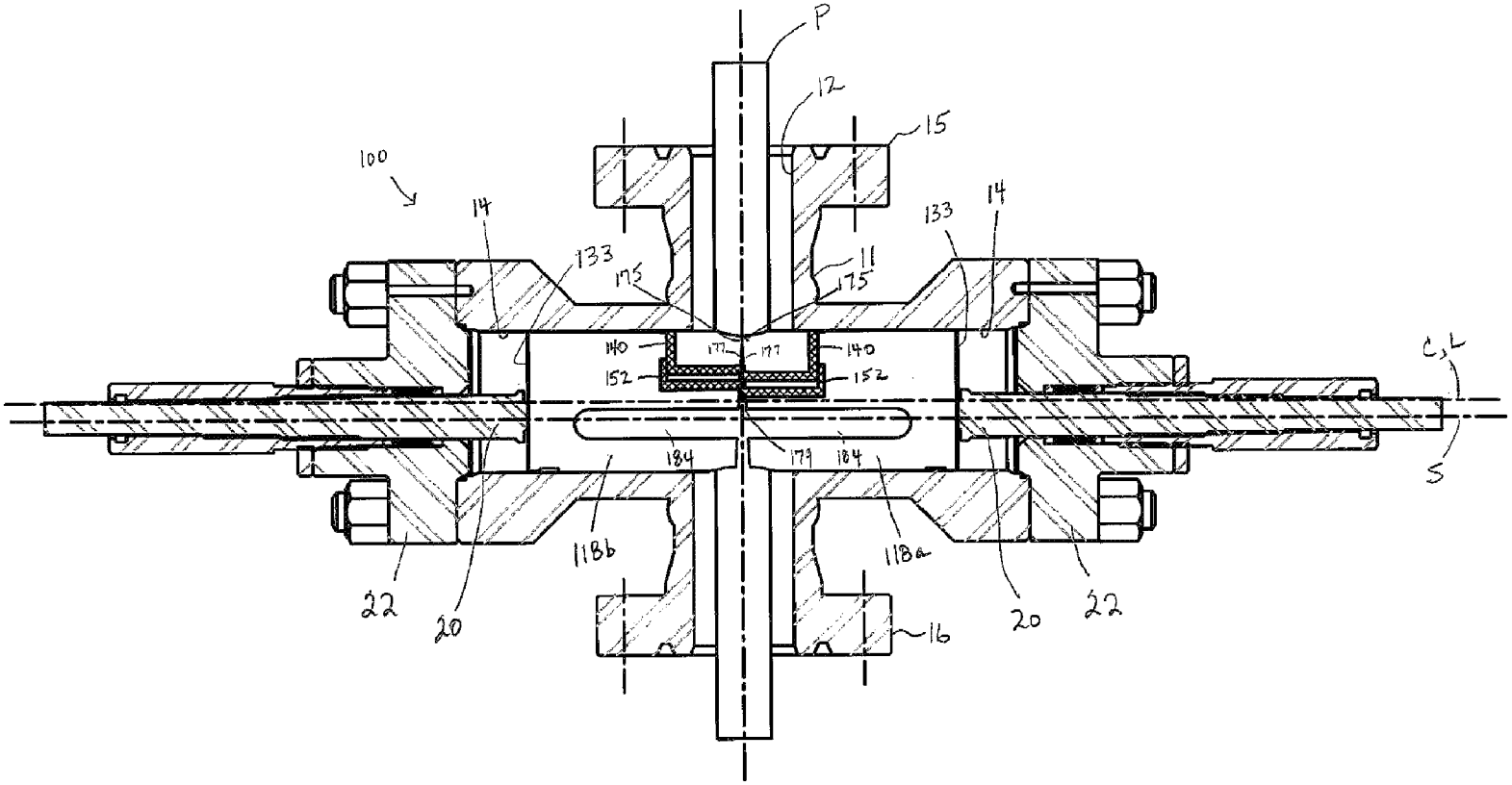
FIG. 14 is a side view of another embodiment of a production blowout preventer (BOP) with the housing, end plugs and ram screws in section, and showing the opposing BOP rams being moved into an extended position with the leading edge portions on the ram front faces adjacent the top portions of the rams making initial contact with each other, and also showing the vertical offset of the rope packing seals at the front faces of the opposing rams, the horizontal slot in the rams below the seals, the inclined portions on the front faces of the rams, and the off center connection of the ram screws at the rear of the rams.
Figure 19:
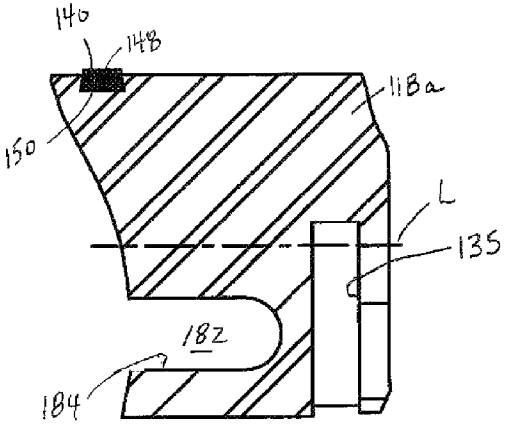
FIG. 19 is a side sectional view taken along line 19-19 of FIG. 18, partially cut away, at the rear end portion of the BOP ram, to show the primary rope packing seal at the top portion of the ram for sealing against the ram bore, and to show the T-slot at the rear end of the ram for the off center connection, below the center axis of the ram bore, to the ram screw.

Having reference to FIG. 14, a production blowout preventer (BOP) is shown generally at 100, to include a cross-shaped, pressure-containing steel housing 11 forming a central bore 12, extending generally vertically through the housing 11, and a pair of co-axial horizontal ram bores 14. The ram bores 14 are slightly larger in diameter than the central bore 12, as is common in BOP devices. Top and bottom flange connectors 15, 16 to wellhead components located above and below the BOP 100 are shown, although alternate top and bottom connectors such as mentioned above may be used. The horizontal ram bores 14 intersect with the central bore 12. The ram bores 14 are formed with a larger diameter than that of the central bore 12, and sealing surfaces are formed across the central bore at the intersection of the bores 12, 14, all as is generally known in the art. The polish rod P is shown in place in the central bore 12. The polish rod P is an example of a tubular member which may be present in the central bore 12.

A pair of generally cylindrical BOP rams 118*a*, 118*b* are shown in FIG. 14. Each of the rams 118*a*, 118*b* may be formed in multiple parts, but are generally cylindrically shaped when assembled for close fitting relationship in, and optionally for sealing to, the ram bores 14. The rams 118*a*, 118*b* are generally formed as steel bodied rams, although one or more coatings may be formed on the rams or portions of the rams. The rams 118*a*, 118*b* are locked onto the ends of ram screws 20, which extend through end plugs or bonnets 22 at the outer ends of the ram bores 14. The ram screws 20 can be turned to extend or retract the rams 118 into or out of the central bore 12 with mechanical screw jacks which can operate on the external ends of the ram screws 20. Each ram screw 20 is connected at the rear face 133 of the ram 118*a*, 118*b*, typically in a T-slot 135 (see FIG. 19), in a manner known in the art. The ram screws 20 can be extended and retracted with other types of ram actuating mechanisms as set out above. The ram screws 20, with the ram actuating mechanisms, extend and retract the rams 118*a*, 118*b* between the open position, in which the rams 118*a*, 118*b* are retracted from the central bore 12, and the closed, sealing position, in which the opposing rams 118*a*, 118*b* are extended to seal against each other, around the polish rod P if present, upwardly against the ram bores 14, and across the sealing surfaces of the central bore 12 to seal the central bore from pressure below.

As above, one of the rams, along with the ram bores, may be adapted to include and accommodate an extended central bore sealing section as described in U.S. Pat. No. 7,552,765. As well, the ram bores 14 and corresponding rams 118*a*, 118*b* are not necessarily strictly cylindrical in shape. The rams and bores may take alternate shapes, such as oval in cross section, as is known in the art. As well, as mentioned above, the rams 118*a*, 118*b*, and the ram screws 20 may be rotated through 180° to seal against pressure from above, in which case, the rams 118*a*, 118*b* seal as above for FIG. 14, but downwardly against the ram bores 14 (instead of upwardly as above).

Figure 15:
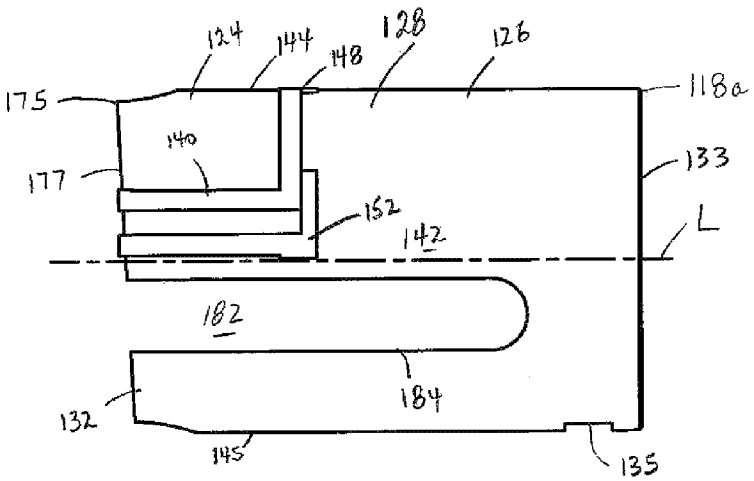
FIG. 15 is a side view of the left side BOP ram of FIG. 14 showing the front face of the ram being formed with an inclined portion which is inclined top to bottom toward the central bore, and showing a primary rope packing seal extending rearwardly along the side of the ram and over the top portion of the ram, a secondary rope packing seal spaced from the primary rope packing seal and extending rearwardly along the side of the ram to meet the primary rope packing seal.

As best shown in FIG. 15, on the right hand ram body 118*a* of FIG. 14, but also applying with general mirror symmetry to left hand ram body 118*b*, the ram 118*a* includes a front end portion 124 (this being the portion which extends into the central bore 12 in the extended position) and a rear end portion 126 (facing the end plugs 22, and which remains within the horizontal ram bore 14 in the retracted and extended positions). The ram bores 14 are each of sufficient length to accommodate the ram 118*a* (or 118*b*) in its fully retracted, open position or its fully extended, sealing position.

Each ram 118*a*, 118*b* is formed from a steel body component 128 which is generally cylindrical in shape for a tight fitting seal in the ram bore 14. The body component 128 may be formed in multiple components, as in FIG. 23 which are assembled to form a cylindrical full body ram, but a single piece steel body component is shown in the FIGS. 14-22.

Figure 17:
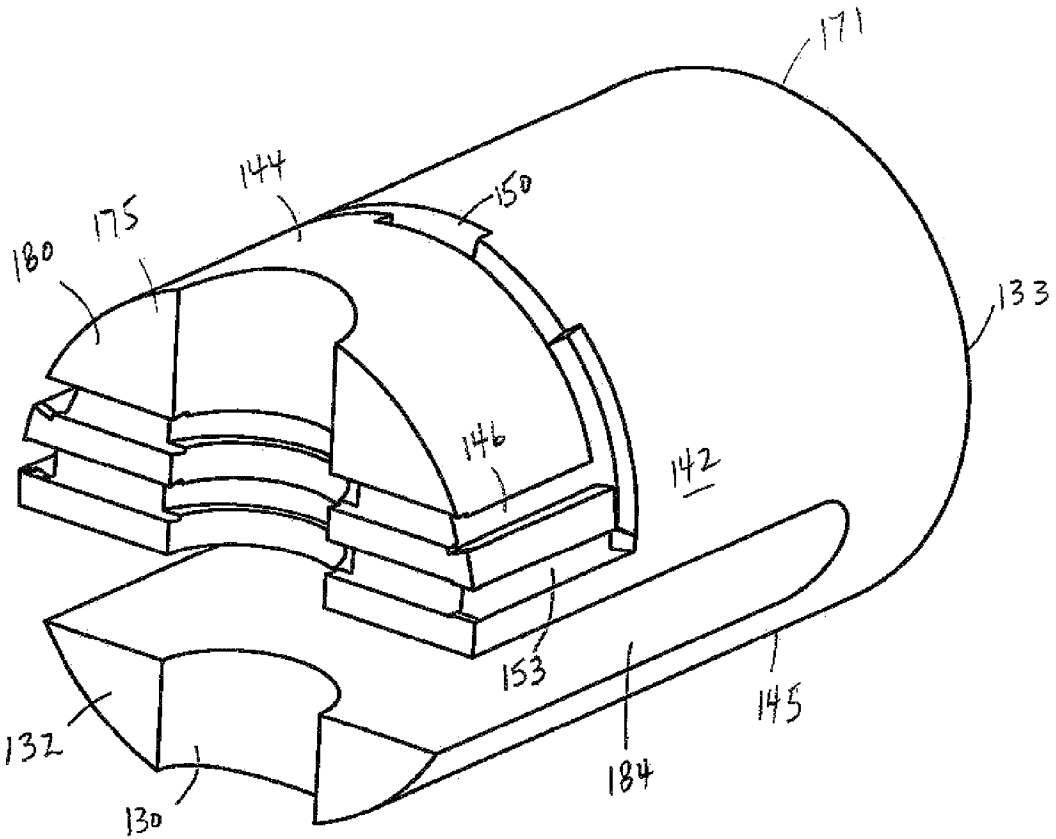
FIG. 17 is a front perspective view of the BOP ram of FIG. 17 with the primary and secondary rope packing seals removed to show a continuous first groove to retain a first length of rope packing and having a widened portion at the top portion of the ram to accommodate overlapping ends of the first length of rope packing, a second groove for a second length of rope packing extending rearwardly to meet the continuous first groove, and a radial vertical groove formed at the front face of the ram to accommodate a polish rod.
Figure 18:
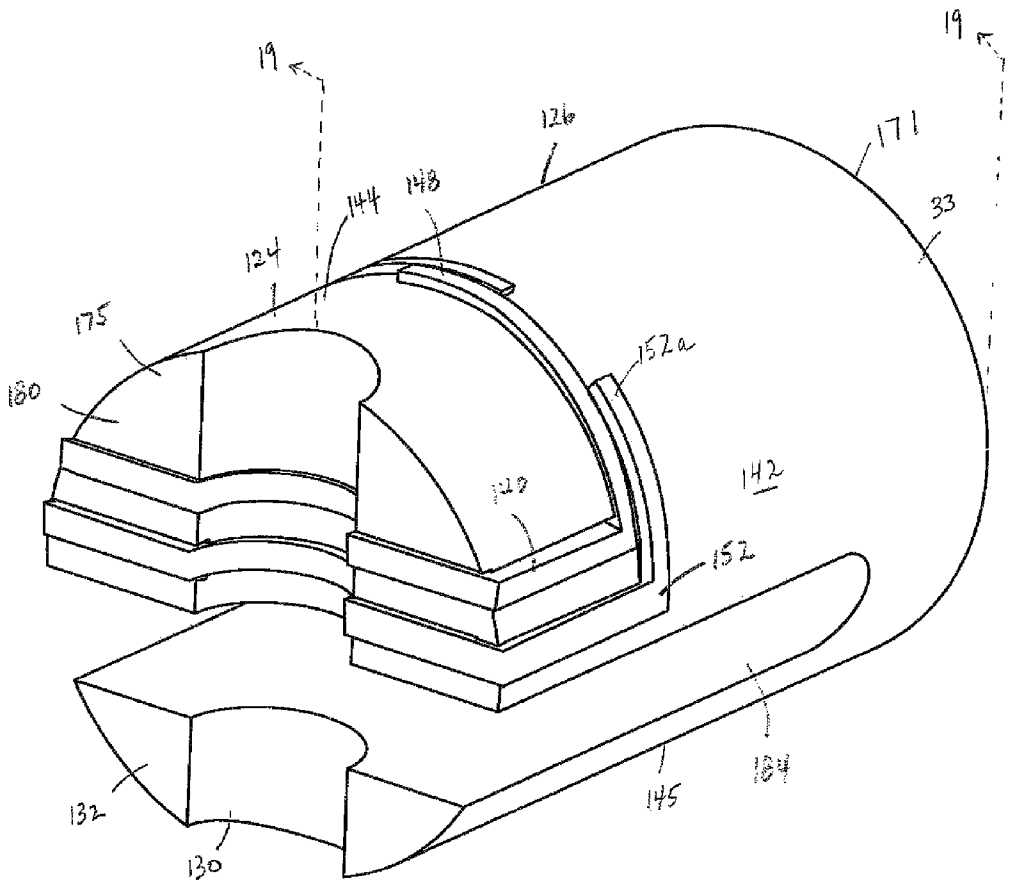
FIG. 18 is a front perspective view of the BOP ram of FIG. 18 with the primary and secondary rope packing seals held in the grooves so as to protrude radially outwardly from the grooves.
Figure 20:
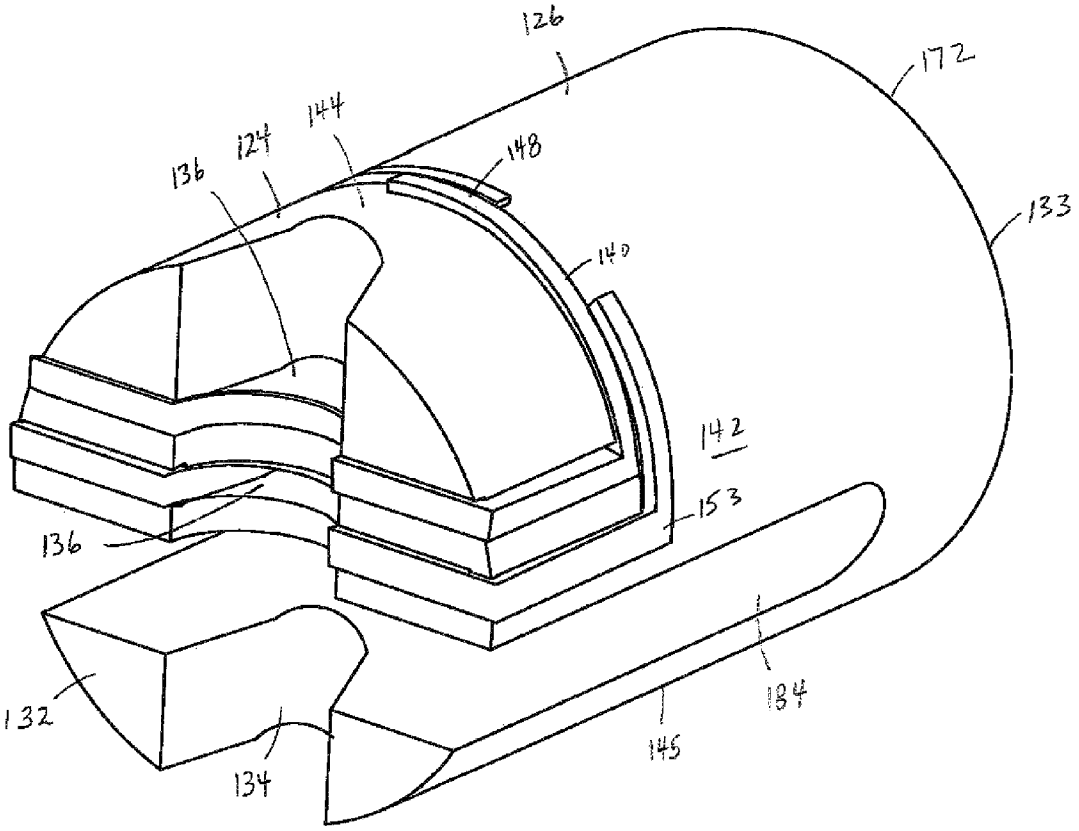
FIG. 20 is a front perspective view of a BOP ram similar to the BOP ram of FIG. 18, but showing a vertical groove which is V-shaped to accommodate at least a portion of the circumference of the polish rod within the V-groove, and showing the primary and secondary rope packing seals extending across a raised radial backing section formed in the V-groove to seal the polish rod.
Figure 21:
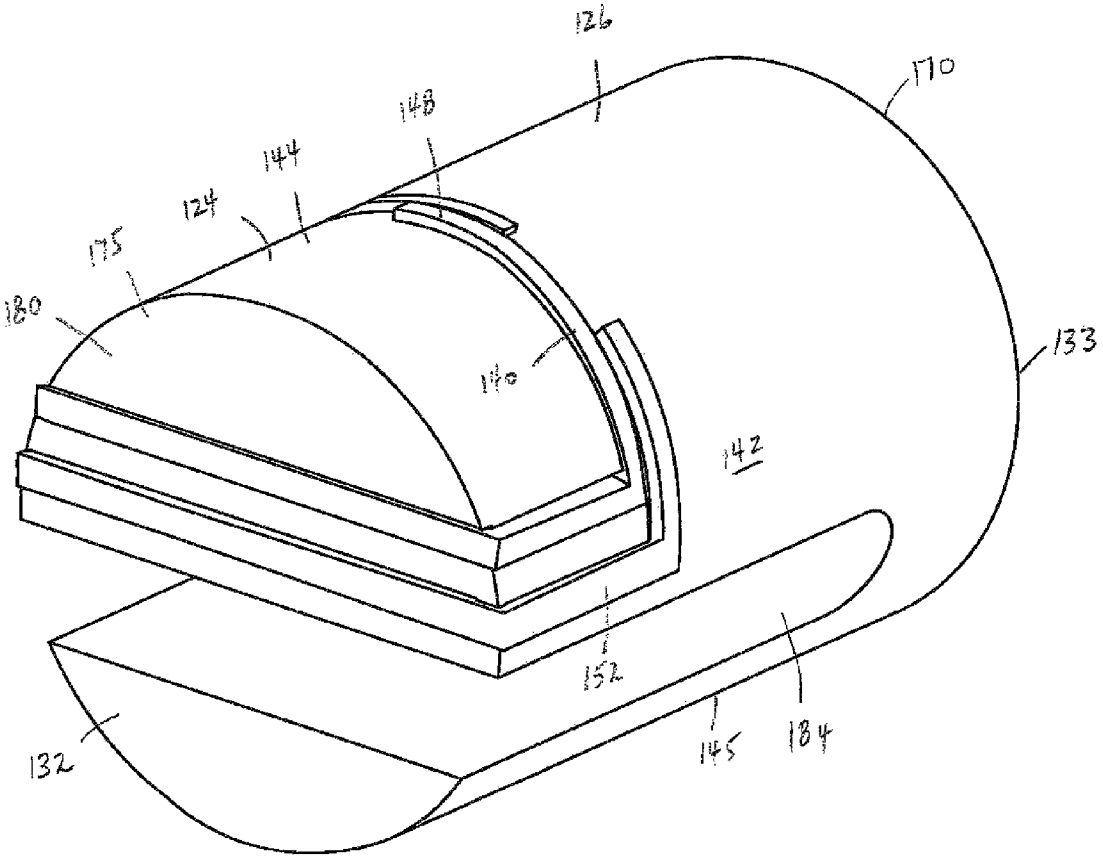
FIG. 21 is a front perspective view of a BOP ram similar to the BOP ram of FIG. 18, but showing a front face formed as a blind ram such that the front faces of opposing rams seal against each other in the extended position to seal the central bore.
Figure 22:
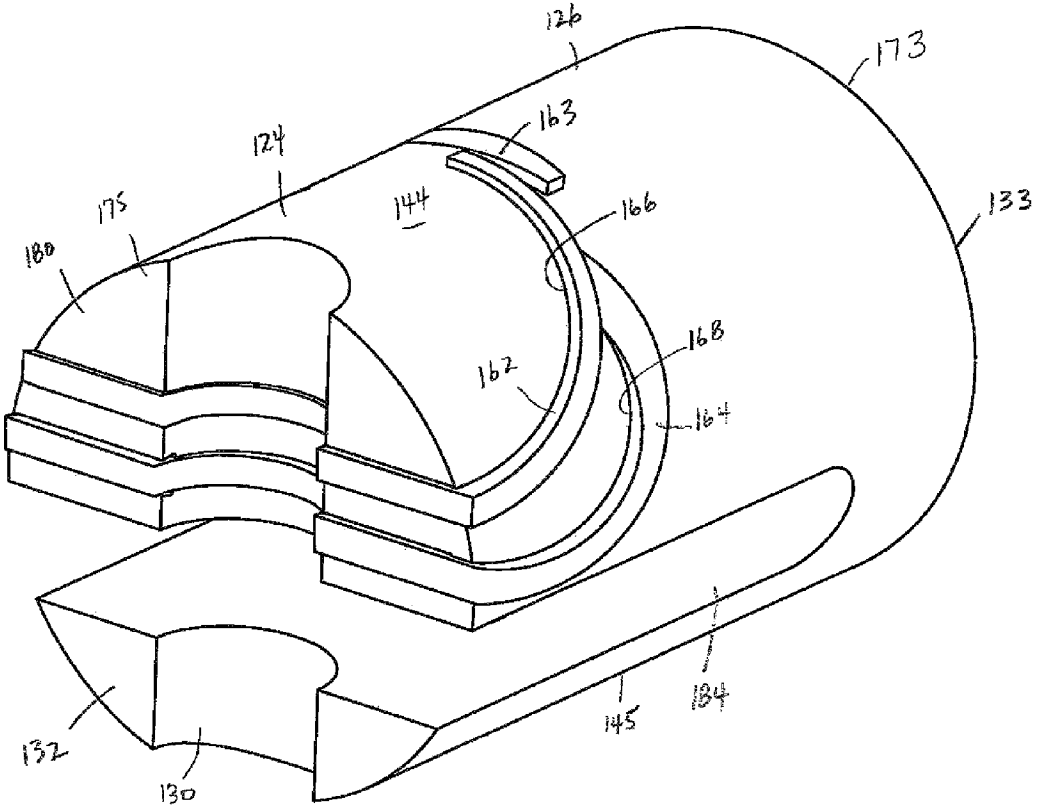
FIG. 22 is a front perspective view of a BOP ram similar to the ram of FIG. 18, but showing the primary and secondary rope packing seals configured with the alternate spacing arrangement as shown in FIG. 10.

The ram 118*a*, 118*b* may be formed with a vertical groove 130 that runs along the front face 132 of the ram 118*b*, 118*b* to accommodate the polish rod P or other tubular member. In FIGS. 17, 18 and 22 the vertical radial groove is shown as generally semi-circular (in horizontal cross section). The vertical groove 130 may be omitted if the front ends of the rams 118*a*, 118*b* are to function as blind rams 170 to seal against each other in the event that the polish rod P is not present, as shown in FIG. 21. Still alternatively, the vertical groove may take the form of a vertical V-groove 134 running along the front face 132, as shown in the ram 172 of FIG. 20, and as described in greater detail in U.S. Pat. No. 7,673,674. The V-groove 134 is sized to accommodate at least a portion of the circumference of the polish rod P within the groove 134. In the V-groove embodiment of FIG. 20, one or more radial shaped, raised backing sections 136 (two shown in FIG. 20, one for each seal) are formed at sealing locations within the V-groove 134. These backing sections 136 being sized to accommodate the polish rod P in a tight fitting relationship in order to seal to the polish rod P.

In FIG. 14, the pair of rams 118*a*, 118*b* are shown being moved into the extended position, but not yet in the fully extended, sealing position. As shown in FIG. 14, and also in FIG. 15, the front face 132 of each of the rams 118*a*, 118*b* is formed with mirror symmetry, with a leading edge portion 175 adapted to first abut or first contact the leading edge portion 175 of the opposing ram 118*a*, 118*b* in advance of the remainder of the front face 132 of the opposing ram 118*a*, 118*b*. In this way, the leading edge portions 175 of the opposing rams 118*a*, 118*b* abut and are then pressed against each other as the rams 118*a*, 118*b* continue to be moved into the extended position by the ram screws 20. This continued pressing against each other of the leading edge portions 175 imparts a generally vertical movement to the opposing ram 118*a*, 118*b*. In the embodiments of FIGS. 14-23, the generally vertical movement is generally upwardly, however, if the rams were rotated 180°, the generally vertical movement is generally downwardly. The generally vertical movement may also be envisaged as a generally upward or downward rotating movement as the rams move through an angle relative to the center axis of the rams bores C.

As shown in FIGS. 14 and 15, each of the rams 118*a*, 118*b* include at least one seal, shown as a primary rope packing seal 140. This seal 140 could alternatively be formed of an elastomeric or thermoplastic material, although the rope packing seal materials may be selected for very high or very low temperature environments in which the elastomeric or thermoplastic seal materials may not function as well, or at all. The primary rope packing seal 140 is formed from a length of rope packing which forms a closed loop on the outer surface of the ram 118*a*, 118*b*. The length of rope packing, and thus the primary rope packing seal 140 extends horizontally across the front face 132 of the ram 118*a*, 118*b*, including across the vertical groove 130, then generally rearwardly, and then upwardly around a portion of the outer surface of the ram 118*a*, 118*b* and over the top portion 144 of the ram 118*a*, 118*b*. Although not shown, the primary rope packing seal 140 could alternatively, extend over the bottom portion 145 of the ram 118*a*, 118*b*. In order to seal the central bore 12, the location at which the primary rope packing seal 140 extends over the top portion 144 (or bottom portion 145) is at a position on the ram 118*a*, 118*b* rearwardly of the front end portion 124, such that the seal 140 at the top portion 144 remains within the ram bore 14 when the ram 118*a*, 118*b* is fully extended so as to seal to the ram bore 14. FIG. 14 shows the seal 140 at the top portion 144 as being located within the ram bores 14, and thus rearwardly of the front end portion 124. In FIGS. 14 and 15, the primary rope packing seal 140 is shown to extend rearwardly along the side wall 142 of the ram 118*a*, 118*b*, and then circumferentially upwardly over the top portion 144. Alternatively, the primary rope packing seal could extend in an arcuate path, both rearwardly and upwardly, such as shown in FIG. 22 (labeled as primary rope packing seal 162 on ram 173). Thus the terms "rearwardly", "upwardly" and "downwardly" as used herein and in the claims with respect to the rope packing seals are not meant to refer to strict horizontal or vertical orientations, but are meant to include arcuate paths.

As shown in FIGS. 14 and 15, the leading edge portions 175 are located above the primary rope packing seal 140, adjacent the top portion 144 of the ram 118*a*, 118*b*. When the generally vertical movement is imparted to the rams 118*a*, 118*b* as they are moved into the extended position, the seals 140 on the front faces 132 are brought into sealing engagement with each other, and the seal 140 extending over the top portion 144 of the ram 118*a*, 118*b* is energized as the ram is moved upwardly against the ram bore 14. In an embodiment in which the rams 118*a*, 118*b* are rotated 180° compared to FIG. 14, the leading edge portions may be located below the seal 140, and the generally downward movement imparted in the extended position energizes the seal 140 downwardly against the ram bore 14.

In the embodiment shown in FIGS. 14 and 15, the front faces 132 of the rams 118*a*, 118*b* are formed with an inclined portion 177 such that a plane through the inclined portion 177 is inclined toward the central bore 12, and in a manner such that the inclined portions 177 on opposing rams 118*a*, 118*b* are brought into contact with each other by the generally vertical movement imparted to the opposing rams 118*a*, 118*b*. The seal 140 may be located on the inclined portion 177, so that as the inclined portions 177 on opposing rams 118*a*, 118*b* are brought into contact with each other, the seals 140 are energized against each other, and against the polish rod P, if present.

In the embodiment of FIGS. 14 and 15, the leading edge portion 175 is located adjacent the top portion 144, and the front face 132 of the ram 118*a*, 118*b* forms one inclined portion, such that a plane through the front face 132 is inclined top to bottom toward the central bore 12. In this embodiment, the inclined portions 177 are shown to leave a horizontal gap 179 between the bottom portions 145 when the rams reach the position across the central bore when the leading edge portions 175 of the opposing rams 118*a*, 118*b* first contact (see FIG. 14 for gap 179). This gap 179 is sized to close as the rams 118*a*, 118*b* are moved into the fully extended, sealing position. In general, the gap 179 is sized by an angle formed between a plane through the inclined portion 177 and a vertical plane through the central axis of the central bore 12. This angle will vary with the size of the BOP and the BOP rams, but is generally less than 10 degrees, such as less than 5 degrees, such as between about 1 and 3 degrees, and such as between about 2 and 3 degrees. In embodiments in which the rams are rotated 180° compared to FIG. 14, this gap 179 will be present at the top of the rams.

As best shown in FIG. 14, to facilitate imparting the generally vertical movement to the ram 118*a*, 118*b*, each of the ram screws 20 is connected to the rear face 133 of the rear end portion 126 of the ram 118*a*, 118*b* at a point below a the center axis C of the ram bores 14 (which is also below the longitudinal axis L of the rams 118*a*, 118*b*). In FIG. 14, the ram screw center line S is shown to be below center axis C and longitudinal axis L. With this feature, as the rams screw 20 pushes on the rear end portion 126, the off center force (below the center in FIG. 14) facilitates an upward rotation of the ram 118*a*, 118*b*, and thus facilitates the generally upward movement of the ram to assist in the sealing actions for the seal 140 described above. In alternate embodiments, in which the ram 118*a*, 118*b* is rotated 180° the ram screw 20 may be connected above the center axis of the ram bore 14 to facilitate a downward movement of the ram.

To further facilitate imparting the general vertical movement to the ram 118*a*, 118*b*, and to allow the ram to flex in the ram bore 14, the front face of the ram 118*a*, 118*b* is formed with a cut away portion 182 located above or below the seal 140. In FIGS. 14-22, the cut away portion 182 is shown as a horizontal slot 184 below the seal 140, extending across the front face 132 and rearwardly in the ram. In an alternate embodiment in which the rams are rotated through 180° compared to FIG. 14, the cut away portion 182 could be located above the seal. In FIGS. 14-22, the horizontal slot 184 is shown to extend rearwardly of the front end portion 124 of the ram to provide a significant flex movement to the ram. However, in alternate embodiments, depending on the size of the rams and the size of the front end gap 179, and thus the rigidity of the steel bodied ram, the horizontal slot may extend rearwardly to a greater or lesser extent to provide the desired amount of flex to initiate the vertical movement and sealing actions of the rams. As an alternative to the horizontal slot, the cut away portion 182 may remove a portion of the ram extending across the entire front face 132 at a location above or below the seal (below the seal when configured as in FIG. 14).

Figure 16:
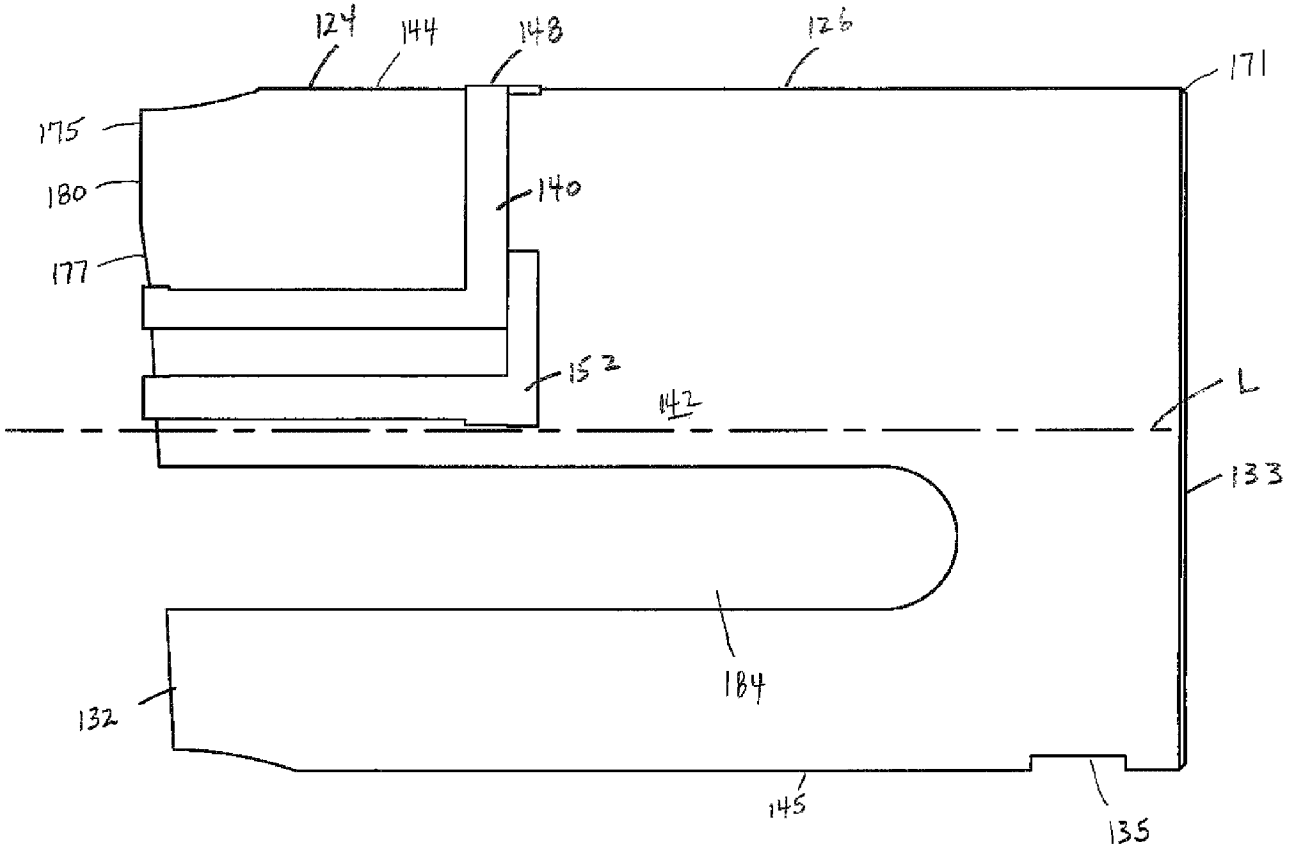
FIG. 16 is a side view of another embodiment of a BOP ram similar to the ram of FIG. 15, but showing the leading edge portion adjacent the top portion of the ram formed as a flattened planar section such that a plane extending therethrough is generally vertical, whereby the flattened planar portions of opposing rams meet in the generally vertical plane at the initial point of contact with each other.

In an alternate embodiment shown in FIG. 16, the leading edge portion 175 is formed on the ram 171 (and on an opposing ram formed with general mirror symmetry) as a flattened planar portion 180. The flattened planar portion 180 may be formed adjacent the top portion 144 of the ram 171. A plane through the flattened planar portion 180 is generally vertical. By forming the leading edge portion 175 as a flattened planar portion 180, the ram 171 has more planar surface area over with to abut the flattened planar portion of the opposing ram at the point of first contact, and to press against the flattened planar portion of the opposing ram in order to impart the generally vertical (upward for ram 171) movement to the ram 171. In FIG. 16, the ram 171 is formed with the inclined portion 177 located directly below the leading edge portion 175, and inclined from the leading edge portion to the bottom portion toward the central bore. As noted above for the ram 118*a*, the ram 171 may be rotated 180° for sealing downwardly in alternate embodiments.

The leading edge portions 175 and the inclined portions 177 may be alternately configured than as shown in the figures, provided the leading edge portion 175 is the point of first contact with the opposing rams (apart from any protruding seals), and provided these portions and any other surfaces at the front face 132 allow for the generally vertical movement and sealing actions of the ram, as above-described, in the extended position.

As described above, the rams 118*a*, 118*b* may be formed with a primary rope packing seal 140. In FIGS. 14-21, the primary rope packing seal 140 is configured similarly to the embodiment shown in FIGS. 1-2, formed from a single length of rope packing material held in a continuous first groove 146 (see FIG. 17, with the rope packing seals removed) and having overlapping end portions 148 held in side by side relationship at the top portion 144 of the ram in a widened groove 150. In FIG. 22, the primary rope packing seal 162 is configured similarly to the embodiment shown in FIG. 10 in which the primary rope packing seal 162 follows a generally arcuate path in the continuous first groove 166, over the top portion 144 such that the overlapping end portions 163 are accommodated in a widened portion of the continuous first groove 166, as described above.

A secondary rope packing seal 152 may be included, as shown in FIGS. 14-22. In FIGS. 14-21, the secondary rope packing seal 152 is configured similarly to the embodiment of FIGS. 1-2, except that the ends 152*a* of second length of rope packing meet the primary rope packing seal 140 at the side wall 142 of the ram with overlap between the primary and secondary rope packing seals 140, 152. The secondary rope packing seal 152 extends horizontally across the front face 132, including across any vertical groove 130, preferably parallel and spaced below the primary rope packing seal 140, held within a second groove 153 (see FIG. 17 with the rope packing seals removed). The secondary rope packing seal 152, within second groove 153 extends rearwardly along the side wall 142 of the ram, generally spaced from and below the primary rope packing seal 140, and then upwardly to meet the primary rope packing seal 140. In FIG. 22, the secondary rope packing seal 164 is similar to the embodiment shown in FIG. 10, with the secondary rope packing seal 164 following a generally arcuate path in the second groove 168 to meet the primary rope packing seal 162 at the side wall 142.

As with the embodiments of FIGS. 1-13, the first and second grooves may be dove-tail shaped in cross section to retain the first and second lengths or loops of rope packing.

As best shown in FIG. 14, in order to limit a pulling action of the primary rope packing seals 140 at the front face 132 of the ram 118*a*, 118*b* as the seals 140 disengage from each other after sealing against each other, a vertical offset between the seals 140 on opposing rams 118*a*, 188*b* may be added. As shown in FIG. 14, the primary rope packing seal 140 on ram 118*a* is located with a vertical offset relative to the primary rope packing seal 140 on the opposing ram 118*b*, such that the seal 140 on ram 118*a* is located slightly vertically lower on the front face 132 than is the seal 140 on opposing ram 118*b*. However, the seals 140 on the opposing rams 118*a*, 118*b* still overlap slightly so that they may still seal against each other in the extended position, but they seal against each other with the vertical offset. In this manner, as the rams 118*a*, 118*b* are retracted from the extended sealing position, the seals 140 are less likely to pull each other out of the underlying first grooves 146.

Similarly, the secondary packing seals 152 are positioned across the front face 132 of the ram 118*a* with a similar vertical offset relative to the secondary rope packing seal 152 on the front face 132 of the opposing ram 118*b*, such that in the extended position, the secondary rope packing seals 152 on the opposing rams 118*a*, 118*b* seal against each other but with the vertical offset.

This vertical offset feature of the front face seals 140, 152 is a feature for which the opposing rams 118*a*, 118*b* do not share mirror symmetry. However, as is apparent from the FIGS. 14-23, and from the description of the embodiments of FIGS. 14-23 herein, other features of the opposing rams are formed with mirror symmetry, including the leading edge portions, the inclined portions, the cut-away portions and the ram screws off-center connections.

Other embodiments of the primary and secondary rope packing seals, and the optional inclusion of a circumferential rope packing seal located rearwardly of the first and second rope packing seals, may be included, as set out above for the embodiments of FIGS. 1-13. Any of the primary, secondary and circumferential rope packing seals may be formed from a continuous loop of rope packing material, in which case overlapping or adjoining two ends of the lengths of rope packing do not need to be accommodated, and a continuous groove may be used to hold each loop of rope packing.

Figure 23:
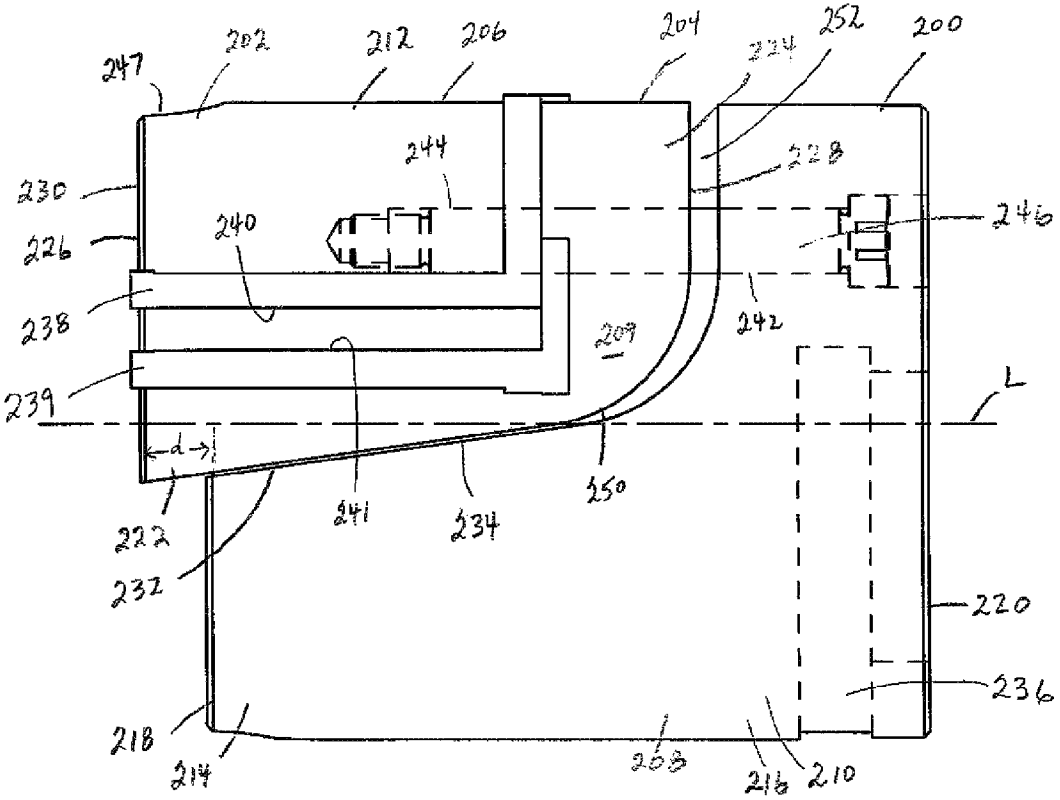
FIG. 23 is a side view of an alternate embodiment of a production BOP ram formed with a bottom body component and a top seal component, the components being connected and configured such that the seal component, in the extended position, is pressed against an inclined seal support surface of the body component and rides upwardly and rearwardly on the seal support surface. The BOP ram is shown to include primary and secondary rope packing seals formed on the seal component.

In the embodiment shown in FIG. 23, a production BOP ram 200 is shown generally configured to be positioned in the ram bores 14 of a BOP housing 11 such as shown in FIG. 14. In the description herein, the ram 200 is described as if positioned in the BOP housing 11 of FIG. 14, with like parts being labeled with the same reference numbers. The ram 200 has a front end portion 202, a rear end portion 204, a top portion 206, a bottom portion 208 and side walls 209. In an extended position, the front end portion 202 extends across the central bore 12 and the rear end portion 204 is within the ram bore 14. In a retracted position, the ram 200 is within the ram bore 14. The ram 200 is shown to consist of a steel body component 210 forming the bottom portion 208 of the ram 200, and a steel seal component 212 forming the top portion 206 of the ram 200. When assembled, the body component 210 and the seal component 212 form a full body ram. Each of the opposing rams 200 is formed generally with mirror symmetry to each other, and are each generally cylindrical in shape for a tight fitting seal in the ram bore 14. The body component 210 has a front portion 214, a rear portion 216, a front end 218 and a rear end 220. The seal component 212 has a front portion 222, a rear portion 224, a front end 226, a rear end 228 and a front face 230.

The seal component 212 is shaped to fit into a cut-out 232 formed at the front portion 214 of the body component 210. The cut-out 232 provides a seal support surface 234 to support the seal component 212 in both a vertical and horizontal direction. The cut-out 232 may be generally L-shaped, as shown. However, similarly to that described in U.S. Pat. No. 7,137,610, the cut-out portion may have an alternate shape, such as a wedge shape. The rear end 216 of the body component 210 is formed with a central T-slot 236 to connect and lock onto the end of the ram screws 20, such as shown in FIG. 14.

The seal component 212 includes a primary rope packing seal 238 formed entirely on the outer surface of the seal component 212. The primary rope packing seal 238 extends across the front face 230 of the seal component 212, rearwardly and then upwardly over the top portion 206 of the ram 200 at a position rearwardly of the front end portion 202 of the ram 200. As with the embodiments of FIGS. 14-23, the primary rope packing seal 238 is formed from a first length or loop of rope packing, and is held within a continuous first groove 240 formed similar to the continuous first groove in the embodiments described hereinabove.

As set out above for the embodiments of FIG. 14, the primary rope packing seal 238 may be positioned across the front face 230 of the seal component 212 with a vertical offset relative to the primary rope packing seal 238 on the front face 230 of the seal component 212 of the opposing ram 200, such that in the extended position, the primary rope packing seals 238 on the opposing rams 200 seal against each other but with the vertical offset.

A secondary rope packing seal 239 may be included on the seal component 212 similar to that shown in FIGS. 14-22. The secondary rope packing seal 239 extends horizontally across the front face 230 of the seal component 212, including across any vertical groove which may be present, preferably parallel and spaced below the primary rope packing seal 238, and held within a second groove 241. The secondary rope packing seal 239, within second groove 241 extends rearwardly along the side walls 209 of the ram 200, generally spaced from and below the primary rope packing seal 238, and then upwardly to meet the primary rope packing seal 238.

Similarly to above described embodiments, the secondary packing seal 239 may be positioned across the front face 230 of the seal component 212 with a vertical offset relative to the secondary rope packing seal 239 on the opposing ram 200, such that in the extended position, the secondary rope packing seals 239 on the opposing rams 200 seal against each other but with the vertical offset. As mentioned above for the embodiment of FIG. 14, this vertical offset feature will generally be a feature for which the opposing rams 200 do not share mirror symmetry.

Each of the body and seal components 210, 212 are formed with a pair of aligned horizontal pin bores 242, 244 respectively, to accommodate a pair of side by side connecting pins 246. Both the pin bores 242, 244 and one of the connecting pins 246 are shown in dotted outline in the side view of FIG. 23. One design of the connecting pins 246 is shown in FIG. 23, but alternate embodiments are described in U.S. Pat. No. 7,137,610.

Each of the body and seal components 210, 212 may be formed with a vertical radial groove 247 that runs along the front of the assembled ram 200 to accommodate and seal against the polish rod P, if present. The vertical radial groove 247 may be omitted if the front ends of the rams 200 are to function as blind rams to seal against each other in the event that the polish rod is not present. As shown, in its assembled and connected form with the body component 210, the front end 226 of the seal component 212 protrudes beyond the front end 218 of the body component 210 by a horizontal distance "d". This protruding front end 226 of the seal component 212 acts as a leading edge portion of the ram 200, similar to the leading edge portion 175 described above for the embodiments of FIGS. 14-22.

The seal component 212 is generally semi-cylindrical in shape such that, when connected to the body component 210, the ram 200 is a full bore ram, conforming to the horizontal ram bores 14. In the embodiment shown, the seal component 212 includes the primary rope packing seal 238 at its outer circumference. As more fully explained below, when the rams 200 are advanced into the extended position against the polish rod P, the primary rope packing seal 238 encircles the central bore 12 and thus functions to seal the central bore 12 when the opposing rams 200 are fully engaged against the polish rod P.

The L-shaped cut-out 232 of the body component 210 is formed with a slightly inclined (front to rear), acutely angled seal support surface 234. A similarly angled lower surface 250 is formed on the seal component 212, such that in the extended position, the seal component 212 rides upwardly and rearwardly on the seal support surface 234 of the body component 210, as the rams 200 are moved into the extended, sealing position to close the central bore 12. In its assembled, connected state, when not in the extended position, the seal component 212 is seated in the L-shaped cut-out 232, and a gap 252 remains at the rear end 228 of the seal component 212 between the components 210, 212. The horizontal distance "d" by which the front end 226 of the seal component 212 protrudes beyond the body component 210 is slightly greater than the horizontal width of the gap 252, to ensure a sealing action to the polish rod P.

In the extended position the opposing rams 200 seal against each other, against the polish rod P, and outwardly against the horizontal ram bores 14 and the sealing surfaces of the central bore 12 to effectively seal the central bore 12 of the BOP housing 11 against pressure from below. As the rams 200 are initially advanced in the ram bores 14, the protruding front ends 226 of the seal components 212 meet each other around the polish rod P, causing the seal components 212 to ride upwardly and rearwardly on the acutely angled seal support surfaces 234 of the body components 210, until the gaps 252 between the seal and body components 212, 210 are closed, and the primary rope packing seals 238 on the seal components 212 are pressed against each other to seal the front faces 230 of the seal components 212 and to seal around the polish rod P. As well, the rearward and upward movement of the seal component 212 on the seal support surface 234 of the body component 210 moves the primary rope packing seal 238 located at the top portion 206 of the ram 200 upwardly to seal against the ram bore 14. The primary rope packing seal 238 also seals against the sealing surfaces of the central bore 12.

Alternate embodiments of the seal and body components will be apparent to one skilled in the art from the embodiments described in U.S. Pat. No. 7,137,610, and such embodiments fall within the claims of this application.

The rams 200 described herein include the seal component 212 above the body component 210. However, it should be apparent that the rams 200 could be rotated such that the seal component 212 is on the bottom. Further, the body and seal components 210, 212 may be modified such that both top and bottom seal components are carried on a more generally T-shaped body component to form the cylindrical rams. Furthermore, the components 210, 212 could be oval shaped rather than strictly cylindrical. Furthermore, the body component 210 could be two piece if desired. These and other modifications will be apparent to persons skilled in the art, and are intended to fall within the scope of the present invention.

The embodiments of the BOP as described above and/or the BOP rams described above may be adapted to be included in a composite wellhead assembly including, between a top connector and a bottom connector, together with one or more of the following components, in any sequence, adapters, valves, gate valves, flow tee, additional blowout preventers, and polish rod clamp. To that end, attention is directed to the devices disclosed in the following U.S. Patents, all of which are commonly owned by Stream-Flo Industries Ltd.: U.S. Pat. No. 5,743,332, issued Apr. 28, 1998, entitled "Integral Wellhead Assembly for Pumping Wells"; U.S. Pat. No. 6,457,530, issued Oct. 1, 2002, entitled "Wellhead Production Pumping Tree"; U.S. Pat. No. 6,176,466, issued Jan. 23, 2001, entitled "Composite Pumping Tree with Integral Shut-Off Valve"; and U.S. Pat. No. 6,595,278, issued Jul. 22, 2003, entitled "Assembly for Locking a Polished Rod in a Pumping Wellhead". Each of these patents discloses wellhead equipment used in connection with pumping oil wells, but in a composite form, meaning that one or more functional components of a conventional pumping tree are included in an integral body housing between a top and a bottom connector. Such components may include a shut off valve, a blowout preventer, a flow tee and an adapter. As a composite wellhead, the components are included in an integral tubular body formed from a single piece of steel, and forming an axial, vertical or central fluid flow bore extending therethrough. Multiple side openings are formed in the body, each communicating with the vertical bore, in order to house the valve, BOP and flow tee components. The body includes a bottom connector for connection with a wellhead component located therebelow, for example a flanged top connection of a tubing head. This bottom connection might be a studded down connection, or any other bottom connector such as a flanged connection, clamp-hub connection, rotatable flange connection, welded connection or threaded connection. The body may include a valve housing section above the bottom connection to house a conventional gate valve assembly operative to open or close the central bore. Above the valve housing section may be a first BOP housing section, adapted to house the ram assembly components of one or more of the Figures described above. A second BOP housing section may optionally be formed in the body above the first BOP housing section, housing same or different ram or polish rod clamp components as described above. Above the second BOP housing is typically a flow tee housing section for connection with a conventional flow line, through which well fluid is produced. The body forms a top connector at its upper end for connection with the wellhead component located thereabove, typically a stuffing box. The top connector may include studded connectors, but any other type of connector as indicated above for the bottom connector, may be substituted, as known in the art. As indicated, this is only one exemplary composite wellhead assembly. The components may be provided in different sequences, and may be varied, added or omitted as is appropriate for the needs of a particular wellhead.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention.

One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practiced in the absence of any element or elements, limitation or limitations which is not specifically disclosed herein.

What is claimed is:

1. A ram type blowout preventer, comprising:

a housing forming a central bore extending generally vertically through the housing, and a pair of ram bores extending radially outwardly in opposite directions through the housing and intersecting the central bore;

a steel bodied ram positioned in each of the pair of ram bores to provide opposing rams, the ram having a front end portion, a rear end portion, a top portion and a bottom portion and being adapted for sliding movement in the ram bore between an extended position, with the front end portion extending across the central bore and the rear end portion within the ram bore, and a retracted position within the ram bore, the ram being configured with a front face to seal against the front face of the opposing ram and to accommodate and seal against a tubular member or rod, if present in the central bore;

a ram actuating mechanism connected to the rear end portion of the ram for extending and retracting the ram between the extended and retracted positions;

a seal on the steel bodied ram, the seal extending across the front face, then rearwardly, and then either upwardly over the top portion or downwardly over the bottom portion, at a position rearwardly of the front end portion; and the front face of the steel bodied ram forming a leading edge portion located either above or below the seal so that, as the opposing rams are moved into the extended position, the leading edge portions of the opposing rams abut and press against each other, imparting a generally vertical movement to the opposing rams so that the rams rotate upwardly or downwardly through an angle relative to a center axis of the ram bores to bring the seals on the front faces into sealing engagement with each other and to energize the seals extending over the top portion or the bottom portion against the ram bores;

such that, in the extended position, the seals on the opposing rams seal against each other, against the tubular member or rod if present, and also against the ram bores to seal the central bore.

2. The blowout preventer of claim 1, wherein the steel bodied ram is formed as a single piece steel bodied ram.

3. The blowout preventer of claim 2, wherein the front face of the ram includes an inclined portion such that a plane through the inclined portion is inclined toward the central bore, and the inclined portion being adapted to be brought into contact with the inclined portion on the opposing ram by the generally vertical movement imparted to the opposing rams.

4. The blowout preventer of claim 3, wherein the seal is located on the inclined portion of the ram.

5. The blowout preventer of claim 4, wherein the ram actuating mechanism includes a ram screw connected to the rear end portion of the ram at a point either above or below the center axis of the ram bore to facilitate imparting the generally vertical movement to the ram.

6. The blowout preventer of claim 5, wherein the front face of the ram is formed with a cut away portion located above or below the seal to allow the ram to flex in the ram bore.

7. The blowout preventer of claim 6, wherein the cut away portion comprises a horizontal slot extending across the front face and rearwardly in the ram.

8. The blowout preventer of claim 7, wherein the horizontal slot extends rearwardly of the front end portion of the ram.

9. The blowout preventer of claim 7, wherein the inclined portion of the ram is inclined such that the plane through the inclined portion forms an angle relative to a vertical plane which is less than 10 degrees.

10. The blowout preventer of claim 9, wherein the angle is less than 5 degrees.

11. The blowout preventer of claim 9, wherein the angle is between 1 and 3 degrees.

12. The blowout preventer of claim 9, wherein the angle is between 2 and 3 degrees.

13. The blowout preventer of claim 9, wherein the front face of the ram comprises the inclined portion, such that a plane through the front face is inclined top to bottom toward the central bore, and such that the leading edge portion is formed adjacent the top portion of the ram.

14. The blowout preventer of claim 9, wherein the leading edge portion of the ram is a flattened planar portion formed adjacent either the top portion or the bottom portion of the ram, such that a plane through the flattened portion is generally vertical.

15. The blowout preventer of claim 9, wherein:

the leading edge portion of the front face is located adjacent the top portion of the ram;

the inclined portion is located directly below the leading edge portion and is inclined from the leading edge portion to the bottom portion toward the central bore;

the seal extends over the top portion of the ram, such that the generally vertical movement imparted to the ram energizes the seal upwardly against the ram bore;

the ram screw is connected to the rear portion of the ram at a point below the center axis of the ram bore; and the horizontal slot is located below the seal.

16. The blowout preventer of claim 15, wherein the seal is formed from a length or loop of rope packing of a rope packing material in a braided, twisted, woven or knitted form.

17. The blowout preventer of claim 16, wherein the ram bores are generally cylindrical, and wherein the rams are generally cylindrical.

18. The blowout preventer of claim 16, wherein the housing provides a top connector and a bottom connector for connecting and sealing to a wellhead component located above and below the housing.

19. The blowout preventer of claim 16, configured as a composite wellhead assembly and further comprising, between a top connector and a bottom connector, one or more of the following wellhead components, in any sequence: an adapter, a valve, a gate valve, a flow tee, a second blowout preventer, and a polish rod clamp.

20. The blowout preventer of claim 15, wherein the seal comprises a primary rope packing seal formed on the ram from a first length of a rope packing of a rope packing material in a braided, twisted, woven or knitted form and having two ends, the primary rope packing seal extending horizontally across the front face, then rearwardly, and then upwardly over the top portion at a position rearwardly of the front end portion, the primary rope packing seal being held as a closed loop in, so as to protrude radially outwardly from, a continuous first groove formed in the ram, such that in the extended position the primary rope packing seals on opposing rams seal against each other on opposing front faces, against the tubular member or rod if present, and against the ram bores so that the primary rope packing seals themselves seal the central bore.

21. The blowout preventer of claim 20, wherein the primary rope packing seal extends across the front face of the ram with a vertical offset relative to the primary rope packing seal on the front face of the opposing ram, such that in the extended position, the primary rope packing seals on the opposing rams seal against each other but with the vertical offset.

22. The blowout preventer of claim 21, wherein the continuous first groove is adapted to accommodate the two ends of the first length of rope packing as joined abutting ends or as overlapping ends.

23. The blowout preventer of claim 22, wherein the continuous first groove is adapted to accommodate the joined abutting ends of the first length of rope packing at the top portion of the ram such that the joined abutting ends are oriented generally perpendicular to, or diagonally across, a longitudinal axis of movement of the ram in the ram bore.

24. The blowout preventer of claim 22, wherein the continuous first groove forms a widened portion at the top portion of the ram such that the overlapping ends of the first length of rope packing are held side by side and are oriented generally perpendicular to a longitudinal axis of movement of the ram in the ram bore.

25. The blowout preventer of claim 24, further comprising a secondary rope packing seal formed on the ram from a second length or loop of rope packing of a rope packing material in a braided, twisted, woven or knitted form extending horizontally across the front face, and being spaced from the primary rope packing seal, the secondary rope packing seal being held in, so as to protrude radially outwardly from, a second groove formed in the ram, wherein the secondary rope packing seal extends across the front face of the ram with a vertical offset relative to the secondary rope packing seal on the front face of the opposing ram, such that in the extended position, the secondary rope packing seals on the opposing rams seal against each other but with the vertical offset.

26. The blowout preventer of claim 25, wherein:

the second groove extends across the front face of the ram and then generally rearwardly to meet the continuous first groove;

the secondary rope packing seal is formed from the second length of rope packing to form two ends; and the second length of rope packing extends rearwardly within the second groove such that each of the two ends of the second length of rope packing meets the primary rope packing seal.

27. The blowout preventer of claim 25, wherein the first groove and the second groove are generally dove-tail shaped in cross section to hold the first or second length of rope packing.

28. The blowout preventer of claim 25, wherein the front face of the ram is formed as a blind ram such that the front faces of the opposing rams seal against each other in the extended position to seal the central bore.

29. The blowout preventer of claim 25, wherein the front face of the ram is formed with a vertical groove to accommodate the tubular member or rod.

30. The blowout preventer of claim 29, wherein the vertical groove is a radial groove.

31. The blowout preventer of claim 29, wherein the vertical groove is V-shaped to accommodate at least a portion of the circumference of the tubular member or rod within the V-groove, and wherein the primary rope packing seal and the secondary rope packing seal extend across a raised radial backing section formed in the V-groove to seal to the tubular member or rod.

32. The blowout preventer of claim 1, wherein the front face of the ram is formed with a cut away portion located above or below the seal to allow the ram to flex in the ram bore.

33. A ram type blowout preventer, comprising:

a housing forming a central bore extending generally vertically through the housing, and a pair of ram bores extending radially outwardly in opposite directions through the housing and intersecting the central bore;

a steel bodied ram positioned in each of the pair of ram bores to provide opposing rams, the ram having a front end portion, a rear end portion, a top portion and a bottom portion and being adapted for sliding movement in the ram bore between an extended position, with the front end portion extending across the central bore and the rear end portion within the ram bore, and a retracted position within the ram bore, each ram being configured with a front face to seal against the front face of the opposing ram and to accommodate a tubular member or rod, if present in the central bore;

a ram actuating mechanism connected to the rear end portion of the ram for extending and retracting the ram between the extended and retracted positions;

a primary rope packing seal formed on the ram from a first length or loop of rope packing of a rope packing material in a braided, twisted, woven or knitted form, the primary rope packing seal extending horizontally across the front face, then rearwardly, and then either or both of upwardly over the top portion and downwardly over the bottom portion, at a position rearwardly of the front end portion, the primary rope packing seal being held as a closed loop in, so as to protrude radially outwardly from, a continuous first groove formed in the ram; and the primary rope packing seal extending across the front face of the ram with a vertical offset relative to the primary rope packing seal on the front face of the opposing ram, such that in the extended position, the primary rope packing seals on the opposing rams seal against each other but with the vertical offset;

such that, in the extended position, the primary rope packing seals on the opposing rams seal against each other on opposing front faces, against the tubular member or rod if present, and also against the ram bores so that the primary rope packing seals themselves seal the central bore.

34. The blowout preventer of claim 33, further comprising a secondary rope packing seal formed on the ram from a second length or loop of rope packing of a rope packing material in a braided, twisted, woven or knitted form extending horizontally across the front face, and being spaced from the primary rope packing seal, the secondary rope packing seal being held in, so as to protrude radially outwardly from, a second groove formed in the ram, wherein the secondary rope packing seal extends across the front face of the ram with a vertical offset relative to the secondary rope packing seal on the front face of the opposing ram, such that in the extended position, the secondary rope packing seals on the opposing rams seal against each other but with the vertical offset.

35. A ram type blowout preventer, comprising:

a housing forming a central bore extending generally vertically through the housing, and a pair of ram bores extending radially outwardly in opposite directions through the housing and intersecting the central bore;

a steel bodied, full bore ram positioned in each of the pair of ram bores to provide opposing rams, the ram having a front end portion, a rear end portion, a top portion and a bottom portion and being adapted for sliding movement in the ram bore between an extended position, with the front end portion extending across the central bore and the rear end portion within the ram bore, and a retracted position within the ram bore, the ram being configured with a front face to seal against the front face of the opposing ram and to accommodate and seal against tubular member or rod, if present in the central bore;

an actuating mechanism connected to the rear end portion of the ram for extending and retracting the ram between the extended and retracted positions, each ram comprising:

i. a body component forming the bottom portion of the ram, the body component having a front portion, a rear portion, a front end and a rear end;

ii. a seal component forming the top portion of the ram and extending rearwardly of the front end portion of the ram, the seal component having a front portion, a rear portion, a front end, a rear end, and a front face;

iii. the body component having a cut-out in its front portion to provide a seal support surface to support the seal component, the seal support surface being inclined front to rear such the seal component rides upwardly and rearwardly on the seal support surface;

iv. the seal component having an inner surface which generally conforms to the seal support surface of the body component;

v. the body component and seal component combining, in an assembled form, to form the steel bodied, full bore ram, which when out of the extended position has the front end of the seal component forming a leading edge portion which protrudes a horizontal distance beyond the front end of the body component, and which leaves a gap between the rear end of the seal component and the body component; and vi. connectors for connecting the seal component and the body component while allowing the seal component, in the extended position, to be pressed against the seal support surface of the body component and to ride upwardly and rearwardly on the seal support surface; and a primary rope packing seal formed on the seal component of the ram from a first length or loop of rope packing of a rope packing material in a braided, twisted, woven or knitted form, the primary rope packing seal extending horizontally across the front face of the seal component, rearwardly, and then upwardly over the top portion of the ram at a position rearwardly of the front end portion of the ram, the primary rope packing seal being held as a closed loop in, so as to protrude radially outwardly from, a continuous first groove formed in the seal component;

such that, in the extended position, the primary rope packing seals on the opposing rams seal against each other on opposing front faces, against the tubular member or rod if present, and also against the ram bores so that the primary rope packing seals themselves seal the central bore.

36. The blowout preventer of claim 35, wherein the primary rope packing seal extends across the front face of the seal component with a vertical offset relative to the primary rope packing seal on the front face of the seal component of the opposing ram, such that in the extended position, the primary rope packing seals on the opposing rams seal against each other but with the vertical offset.

37. The blowout preventer of claim 36, further comprising a secondary rope packing seal formed on the ram from a second length or loop of rope packing of a rope packing material in a braided, twisted, woven or knitted form extending horizontally across the front face of the seal component, and being spaced from the primary rope packing seal, the secondary rope packing seal being held in, so as to protrude radially outwardly from, a second groove formed in the seal component, wherein the secondary rope packing seal extends across the front face of each seal component with a vertical offset relative to the secondary rope packing seal on the front face of the seal component of the opposing ram, such that in the extended position, the secondary rope packing seals on the opposing rams seal against each other but with the vertical offset.

38. The blowout preventer of claim 37, wherein the first groove and the second groove are generally dove-tail shaped in cross section to hold the first or second length or loop of rope packing.

39. The blowout preventer of claim 38, wherein the ram is formed as a blind ram such that the front faces of the opposing rams seal against each other in the extended position to seal the central bore.

40. The blowout preventer of claim 38, wherein the front face of the ram is formed with a vertical groove to accommodate the tubular member or rod.

* * * * *